US006189233B1

(12) United States Patent
Halmschlager et al.

(10) Patent No.: US 6,189,233 B1
(45) Date of Patent: Feb. 20, 2001

(54) DRYER SECTION

(75) Inventors: Guenter Halmschlager, Rohrendorf; Walter Holzer, St. Pölten; Karl Steiner, Herbrechtingen, all of (AT)

(73) Assignee: Voith Sulzer Papiermaschinen GmbH, Heidenheim (DE)

( * ) Notice: Under 35 U.S.C. 154(b), the term of this patent shall be extended for 0 days.

(21) Appl. No.: 09/424,835

(22) PCT Filed: Jun. 3, 1998

(86) PCT No.: PCT/EP98/03301

§ 371 Date: Dec. 3, 1999

§ 102(e) Date: Dec. 3, 1999

(87) PCT Pub. No.: WO98/55687

PCT Pub. Date: Dec. 10, 1998

(30) Foreign Application Priority Data

Jun. 3, 1997 (DE) ..... 197 23 163

(51) Int. Cl.[7] ..... D06F 58/00

(52) U.S. Cl. ..... 34/117; 34/119; 34/120

(58) Field of Search ..... 34/114, 115, 117, 34/119, 120, 123; 162/217, 370, 368, 372

(56) References Cited

U.S. PATENT DOCUMENTS

| | | | |
|---|---|---|---|
| 3,416,237 | 12/1968 | Sutherland et al. . | |
| 4,461,095 | 7/1984 | Lehtinen . | |
| 4,622,758 | 11/1986 | Lehtinen et al. . | |
| 4,932,138 * | 6/1990 | Liedes et al. | 34/115 X |
| 5,787,603 | 8/1998 | Steiner et al. . | |
| 5,799,409 | 9/1998 | Chau-Huu et al. . | |
| 5,996,244 * | 12/1999 | Saarikivi et al. | 34/115 |

FOREIGN PATENT DOCUMENTS

| | | |
|---|---|---|
| 3203571 | 10/1982 | (DE) . |
| 3132040 | 3/1983 | (DE) . |
| 3532853 | 4/1986 | (DE) . |
| 4402628 | 8/1995 | (DE) . |
| 29617881 | 1/1997 | (DE) . |
| 19540003 | 5/1997 | (DE) . |
| 93/15268 | 8/1993 | (WO) . |

* cited by examiner

*Primary Examiner*—Stephen Gravini
(74) *Attorney, Agent, or Firm*—Greenblum & Bernstein, P.L.C.

(57) ABSTRACT

Dryer section of a machine for at least one of producing and processing a web of material. The dryer section includes at least one heatable drying cylinder having a circumference, at least a part the circumference adapted to be surrounded by the material web, at least one support band arranged to surround the at least a part of the circumference, and a sealing band arranged to surround the at least a part of the circumference. An overpressure cap is arranged to receive one of a liquid and gaseous medium and is adapted to apply a pressurized one of the liquid and gaseous medium on the at least one drying cylinder. A temperature of the medium is lower than a temperature on an outside of the part of the circumference. At least one second support band is arranged around the at least one drying cylinder and is positioned between the at least one support band and the sealing band, wherein the at least one second support band has a coarser structure than the at least one support band.

46 Claims, 10 Drawing Sheets

DRYER SECTION

CROSS-REFERENCE TO RELATED APPLICATIONS

The present application is a U.S. National Stage Application of International Application No. PCT/EP98/03301 filed Jun. 3, 1998 and claims priority under 35 U.S.C. § 119 of German Patent Application No. 197 23 163.2 filed Jun. 3, 1997.

BACKGROUND OF THE INVENTION

1. Field of the Invention

The invention relates to a dryer section of a machine for producing and/or processing a web of material, especially a paper or cardboard web, having at least one heatable drying cylinder which, around part of its circumference, is surrounded by the material web and at least one support band, and having an overpressure cap which is able to impinge upon the drying cylinder with a pressurized liquid or gaseous medium.

2. Discussion of Background Information

Dryer sections of the type referred to here are known (DE-OS 195 40 003.8). A known dryer section includes a heatable drying cylinder around which a material web and a porous support band are guided. The material web is pressed against the circumference of the drying cylinder by the pretensioned support band. An overpressure cap, which impinges upon a partial circumference of the drying cylinder with a pressurized gaseous medium, is associated with the drying cylinder. The gas pressure is applied directly on the side of the material web facing away from the drying cylinder. This improves the drying contact between the material web and the surface of the drying cylinder. It has proven to be especially disadvantageous that the discharge of the liquid leaving the material web as vapor is impeded by the support band, such that only relatively low drying rates can be realized.

SUMMARY OF THE INVENTION

Consequently, the present invention provides a dryer section of the type mentioned in the introduction which does not have the above-noted application disadvantage.

Accordingly, the gaseous medium of the dryer section has a temperature that is lower than the temperature on the outside of the partial circumference of the drying cylinder surrounded by the material web and the support band; and Because the temperature of the liquid or gaseous medium is lower than the temperature on the outside of the partial circumference of the drying cylinder surrounded by the material web and the support band, a great discharge of liquid from the material web can be obtained. The support band and the side of the material web adjacent to the support band are cooled by the preferably liquid medium such that a temperature drop from the heated drying cylinder in the direction of the support band ensues. Both the heat flow is increased and the discharge direction of the liquid leaving the material web partially as vapor is established thereby. Thus, the liquid preferably leaves the material web on the side adjacent to the support band. Due to the cooling of the support band by the medium, the liquid precipitates in the support band as condensate immediately after leaving the material web and is absorbed thereby. High drainage performance is achieved by the cooling of the support band and the material web, such that the drying performance of the dryer section can be increased while the structural length remains constant.

An exemplary embodiment of the dryer section in which at least one additional, second support band is guided on the outside around the drying cylinder is preferred. The second support band is thus guided such that the first support band is arranged between the material web and the second support band. Because the second support band is cooled directly by the pressurized medium, its temperature is lower than that of the first support band. In this way, and the liquid leaving the material web as vapor precipitates as condensate in the second support band. The vapor leaving the material web thus first penetrates the porous first support band and is absorbed by the second support band such that remoistening of the material web can be kept low. Obviously, it is also possible to guide more than two support bands, for example, three support bands, which are cooled by the gaseous medium, outside around the drying cylinder.

In an advantageous exemplary embodiment, provision is made for the second support band to have a coarser structure than the first support band. The support bands usually have a fabric-like structure. The fabric can have intertwined threads, for example, including multiple individual threads. In connection with the present invention, the term "structure" means the structure of the fabric, i.e., a support band with a coarse structure has larger intermediate spaces between the intertwined threads than a support band with a finer structure, whose threads are more densely intertwined. The first support band, adjacent to the material web, thus has a finer structure than the second support band, such that markings of the material web can be reliably avoided.

An exemplary embodiment of the dryer section distinguished by the fact that a medium-impermeable sealing band is guided on the outside around the drying cylinder is especially preferred. In connection with the present invention, the term "impermeable sealing band" means a liquid- and/or gas-impermeable band. At least one support band, which serves to absorb the liquid leaving the material web, is arranged between the sealing band and the material web. Because of the impermeability of the sealing band, the media pressure adjacent to the sealing band on the outside can be precisely transferred to the support band, without the medium being connected with the material web. The material web is pressed by it against the circumference of the drying cylinder, which results in an increased transfer of heat from the drying cylinder to the material web, which increases the discharge rate of the liquid bound in the material web. Moreover, the material web is compacted by the media pressure such that its web properties are clearly improved. The pressure of the preferably liquid medium, especially water, falls within a range from 0.001 bar to 12 bar absolute. The media pressure is preferably adjusted depending on the desired heat output and/or the material web type and may also be higher than 12 bar, if appropriate.

Moreover, an embodiment of the dryer section in which the first support band, the second support band, and/or the sealing band is/are guided outside the pressure chamber of the overpressure cap between the discharge zone in which the band(s) run(s) off the drying cylinder and the intake zone in which the band(s) run(s) onto the drying cylinder is preferred. Thus, good accessibility to the guide devices, such as guide rollers, over which the bands are guided, can be ensured. In addition, the structure of the overpressure cap can be simplified.

And finally, an exemplary embodiment of the dryer section is preferred in which the seals, for example, sealing strips, by which the pressure chamber of the overpressure cap can be sealed against the surroundings, work in coordination, with or without contact, with rollers which are pressed against at least one sealing band/support band or the material web or which are positioned at only a small distance therefrom. In an advantageous exemplary embodiment, provision is made that at least one seal works in coordination with the surface of a roller. Sealing thus occurs in a circumferential zone of the roller in which neither the material web nor a support band or sealing band is present. Thus, with a contact seal, i.e., when the seal touches the surface of the roller, wear of the bands and seals or damage to the material web can be avoided or kept low.

The present invention is directed to a dryer section of a machine for at least one of producing and processing a web of material. The dryer section includes at least one heatable drying cylinder having a circumference, at least a part the circumference adapted to be surrounded by the material web, at least one support band arranged to surround the at least a part of the circumference, and a sealing band arranged to surround the at least a part of the circumference. An overpressure cap is arranged to receive one of a liquid and gaseous medium and is adapted to apply a pressurized one of the liquid and gaseous medium on the at least one drying cylinder. A temperature of the medium is lower than a temperature on an outside of the part of the circumference. At least one second support band is arranged around the at least one drying cylinder and is positioned between the at least one support band and the sealing band, wherein the at least one second support band has a coarser structure than the at least one support band.

According to a feature of the instant invention, a wire can be adapted to be positioned between the material web and the at least one drying cylinder.

In accordance with another feature of the invention, the at least one drying cylinder can include a plurality of drying cylinders, and the overpressure cap can be associated with the plurality of drying cylinders. At least one of the at least one support band, the sealing band, and the at least one second support band may be guided over the plurality of drying cylinders. Further, all of the at least one support band, the sealing band, and the at least one second support band may be guided over the plurality of drying cylinders.

According to still another feature of the invention, the at least one second support band can be guided on an outside of the at least one support band around the at least one drying cylinder.

According to another aspect of the invention, the sealing band can include a medium-impermeable sealing band arranged on an outside of the at least one second support belt around the at least one drying cylinder.

Further, at least two of the at least one support band, the at least one second support band, and the sealing band may be connected to one another.

In accordance with a further aspect of the invention, the at least one drying cylinder may be adapted to directly contact the material web.

According to still another feature of the invention, a band can be positioned between the material web and the at least one drying cylinder.

Moreover, the at least one drying cylinder may include a plurality of drying cylinders and the overpressure cap can be adapted to apply a pressurized one of the liquid and gaseous medium to the plurality of drying cylinders. At least one of the at least one support band, the sealing band, and the at least one second support band may be guided over the plurality of drying cylinders. Further, all of the at least one support band, the sealing band, and the at least one second support band may be guided over the plurality of drying cylinders.

The at least one drying cylinder can include a plurality of drying cylinders, and the overpressure cap may be associated with at least some of the plurality of drying cylinders. At least one of the at least one support band, the sealing band, and the at least one second support band may be guided over the plurality of drying cylinders. At least a second overpressure cap may be associated with a remaining portion of the plurality of drying cylinders which are not associated with the overpressure cap.

According to another aspect of the instant invention, at least one of the at least one support band, the at least one second support band, and the sealing band may be guided inside the overpressure cap.

In accordance with a further feature of the present invention, at least one of the at least one support band, the at least one second support band, and the sealing band can be guided outside of the overpressure cap between a discharge zone, in which the at least one band is guided outside of the overpressure cap runs off the at least one drying cylinder, and an intake zone, in which the at least one band is guided outside of the overpressure cap runs onto the at least one drying cylinder.

The dryer section can further include seals adapted to form pressure seals between a pressure chamber within the overpressure cap and its surroundings. Guide rollers can be adapted for guiding at least one of the at least one band and the material web, and the seals may be arranged to form a pressure seal with the guide rollers in one of a contacting and non-contacting manner.

The at least one drying cylinder can include ends and journal pins, and the dryer section can include covers adapted to seal ends of the overpressure cap in one of a contacting and non-contacting manner against at least one of the circumference, the ends and journal pins and against the guide rollers. Further, at least one of the guide rollers can be arranged to be pressable against the at least one drying cylinder.

Still further, at least one guide roller can be positioned at arranged at a small distance from the at least one drying cylinder. At least one seal may be positioned adjacent a surface of the at least one guide roller to from a pressure seal.

Moreover, two rollers can be arranged to form a press nip, and the material web may be guided into a pressure chamber formed within the overpressure cap through the press nip. The two rollers forming the press nip can include a shoe press.

In accordance with still another aspect of the present invention, a band tension for at least one of the at least one support band, the at least one second support band, and the sealing band can be adjustable.

According to a further feature of the invention, the one of the liquid and gaseous medium can be pressurized in the overpressure cap in a range between 0.001 bar absolute and 12 bar absolute.

In accordance with a still further feature of the present invention, a pressing device may be arranged to support a pressing of the material web against the at least one drying cylinder. The pressing device can be adapted to apply pressing forces of different magnitudes over subzones of at least one of the circumference and a width of the at least one drying cylinder.

The overpressure cap can include a pressing device having zones for applying different pressure values. In the zones, different pressing forces may be applied in at least one of a travel direction and cross-wise to the travel direction of the material web. Further, the one of the liquid and gaseous medium can include at least one of compressed air, drying air, vapor, and water. The pressure values with the individual zones can be variable. Same pressure relationships can be present in all overpressure caps. Moreover, zones with different pressure levels with the overpressure cap may be actuatable independently of one another.

According to another aspect of the invention, the overpressure cap can include at least two overpressure chambers arranged cross-wise to a travel direction of the material web, which are sealed against at least one of each other and the surroundings. The overpressure cap can include three overpressure chambers arranged cross-wise to a travel direction of the material web, which are sealed against at least one of each other and the surroundings, or the overpressure cap can include four overpressure chambers arranged cross-wise to a travel direction of the material web, which are sealed against at least one of each other and the surroundings. Further, sealing strips may be positioned between at least one of the at least two overpressure chambers and the surroundings. The sealing strips may be adapted to provide an adjustable outflow of air in order to establish a smooth pressure transition.

According to a further aspect of the instant invention, the sealing band can be made of any substances/materials which have good heat conductivity.

In accordance with a still further aspect of the present invention, the sealing band may be made of at least one metal. Moreover, the at least one metal can be steel.

According to still another aspect of the invention, the overpressure cap can be arranged to seal at least the part of the circumference and can be adapted to form one of a pressure chamber and an overpressure chamber in which the part of the circumference is located.

In accordance with another feature of the invention, the web of material can be one of a paper and a cardboard web.

The invention is directed to a dryer section of a machine for at least one of producing and processing a web of material. The dryer section includes at least one heatable drying cylinder having a circumference, at least a part the circumference adapted to be surrounded by the material web, at least one support band arranged to surround the at least a part of the circumference. An overpressure cap is arranged to receive one of a liquid and gaseous medium and is adapted to apply a pressurized one of the liquid and gaseous medium on the at least one drying cylinder. A temperature of the medium is lower than a temperature on an outside of the part of the circumference. At least one second support band is arranged around the at least one drying cylinder and is positioned adjacent the at least one support band, wherein the at least one second support band has a coarser structure than the at least one support band.

According to a feature of the instant invention, the at least one drying cylinder can include a plurality of drying cylinders, and the overpressure cap can be associated with the plurality of drying cylinders. At least one of the at least one support band and the at least one second support band may be guided over the plurality of drying cylinders. Further, both of the at least one support band and the at least one second support band can be guided over the plurality of drying cylinders.

According to another feature of the invention, the at least one second support band can be guided on an outside of the at least one support band around the at least one drying cylinder.

In accordance with yet another feature of the present invention, a medium-impermeable sealing band can be arranged on an outside of the at least one second support belt around the at least one drying cylinder.

Further advantageous embodiments are disclosed in the remaining subordinate claims.

BRIEF DESCRIPTION OF THE DRAWINGS

The invention is explained in detail in the following with reference to the drawings. They depict.

DETAILED DESCRIPTION OF THE PRESENT INVENTION

The dryer section described in the following is generally usable in connection with a machine for producing and/or processing a material web, for example, in a coating machine. Purely by way of example, it is assumed that this is a dryer section of a paper production machine.

Figure 1:
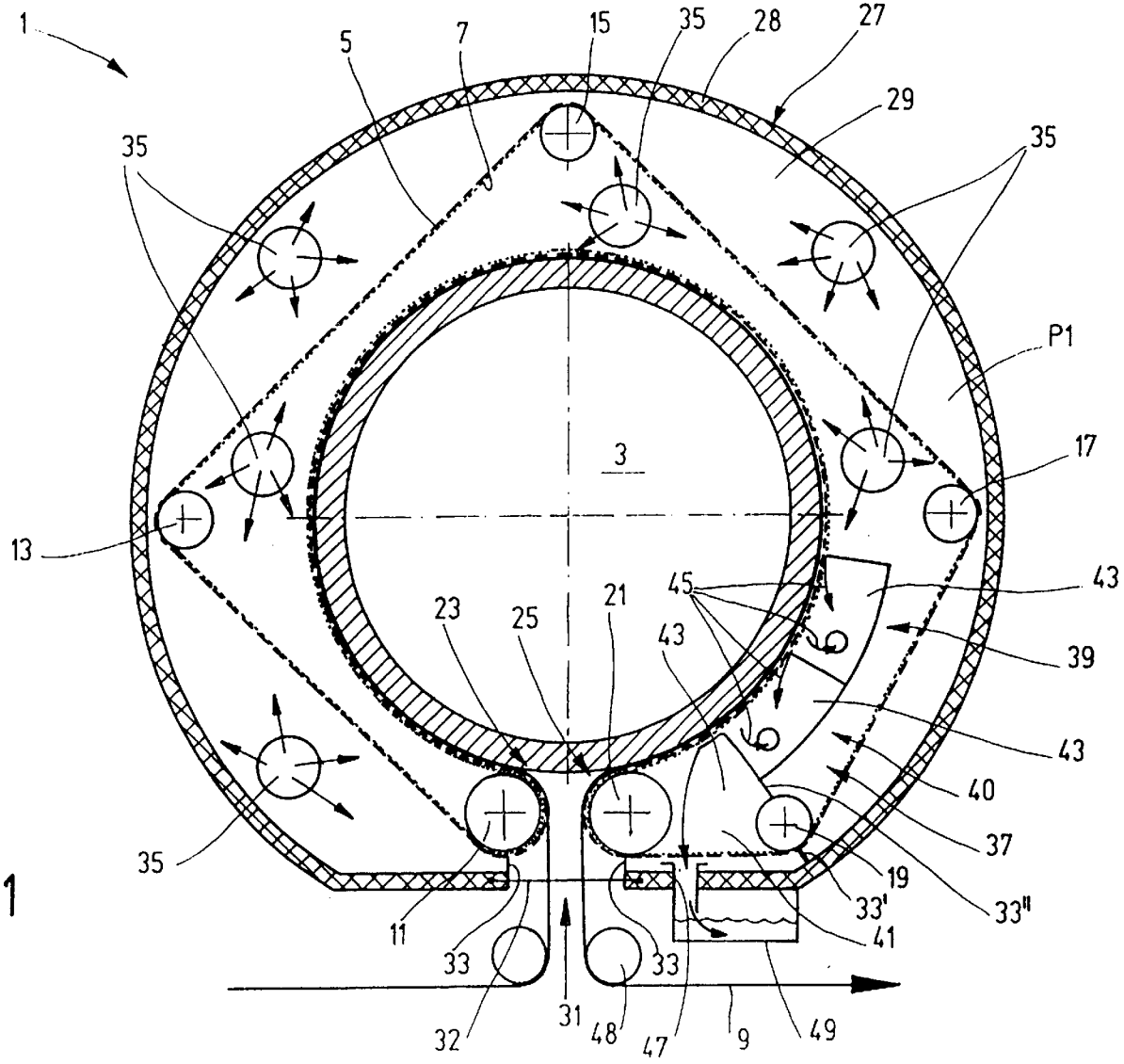
FIG. 1 a schematic side view of a portion of a first exemplary embodiment of a dryer section.

FIG. 1 schematically depicts a portion of an embodiment of a dryer section 1 in a side view, namely a drying cylinder 3, over which a first support band 5 and a second support band 7 are guided along with a material web 9. The support bands 5, 7 are also called drying wires or felts. In this exemplary embodiment, the material web 9 lies directly on the surface of the drying cylinder 3. The porous, i.e., gas and liquid permeable, support bands 5, 7 are guided together over guide rollers 11, 13, 15, 17, 19, and 21 such that the first support band 5 is adjacent to the material web 9 and the second support band 7 is adjacent to the first support band 5 on the outside. The support bands 5, 7 are pretensioned such that the material web is pressed against the circumference of the drying cylinder 3, a circumstance which results in an increase of the drying contact. It is possible to pretension the support bands differently such that, for example, the second support band 7 has a lower pretension (band tension) than the first support band 5. To prevent unacceptably coarse markings on the material web 9 by the first support band 5 adjacent to the material web 9, the support band 5 has a fine structure. The term "fine structure" means a small distance between the pores or threads of the support band. The second support band 7 preferably has a coarse structure but at least a coarser structure than the first support band 5, which will be dealt with in detail in the following. In order to increase the contact surface between the heated surface of the drying cylinder 3 and the material web 9, the guide roller 11 arranged in the intake zone 23 and the guide roller 21 arranged in the discharge zone 25 have a relatively small distance between each other. The guide rollers 11, 21 form a nip with the drying cylinder 3 in each case through which the support bands 5, 7 and the material web 9 are guided.

In connection with the present invention, the term "support band" shall also mean a band which is not used for support or applying pressure to the material web but rather, for example, only for absorbing a liquid. The pretensioning of a support band not used for the support of the material web may be selected, preferably adjusted, very low.

In order to improve the drying contact of the material web 9 with the surface of the drying cylinder 3, an overpressure cap 27 is provided, which preferably extends over the entire length of the drying cylinder 3. The overpressure cap 27 here has an annular housing 28, which can be designed in one piece or in multiple pieces. As is discernible in FIG. 1, the guide rollers 11 through 21, over which the support bands 5, 7 are guided, are arranged in the interior of the overpressure cap 27. The overpressure cap 27 is sealed on its ends by covers (not shown) to delimit a pressure chamber 29. The lateral covers are optionally sealed, with or without contact, against the circumference, the ends, and/or on journal pins of the drying cylinder and the guide rollers by suitable devices. The pressure chamber 29 is sealed against its surroundings in the zone in which the annular housing 28 of the overpressure cap 27 has an opening 31 through which the material web 9 is guided into the interior of the overpressure cap 27 into the pressure chamber 29 by seals 33 designed here as sealing strips and the guide rollers 11, 21 forming a nip with the drying cylinder. The guide rollers 11, 21 may be designed as pressure rollers, for example, shoe presses, and pressed against the drying cylinder 3. The transfer of force between the two pressure-free ends of the housing 28 of the overpressure cap 27 subjected to overpressure in the pressure chamber 29 is preferably produced by a mechanical connection 32.

The seals 33 work in coordination with a circumferential zone of the guide rollers 11, 21 over which the support bands 5, 7 are guided. In the exemplary embodiment depicted in FIG. 1, the seals 33 are in contact with the support band 7 guided over the guide rollers 11, 21 in order to prevent a loss of pressure from pressure chamber 29 as much as possible. Alternatively, it is possible for the seals 33 to be positioned a small distance from the guide rollers 11, 21 or from the support band 7 guided on the outside. During impingement upon the pressure chamber 29 with a pressurized gaseous medium, so-called air knives, by which a contact-free seal of the pressure chamber 29 can likewise be realized, can also be used instead of the seals 33.

In the following, the assumption is made that the pressure chamber 29 is impinged upon by a pressurized gaseous medium. Obviously, it is also possible to introduce a pressurized liquid, preferably water, into the pressure chamber 29. The generation of pressure in the pressure chamber 29 using a liquid is particularly advantageous since with a liquid, in comparison with a gaseous medium, a higher pressure can be realized with a lower flow, especially with a smaller amount of the pressure medium. The overpressure to which the liquid or gaseous medium introduced into the pressure chamber 29 is subjected lies in a range from 0.001 bar to 12 bar absolute. The liquid/gas pressure in the pressure chamber 29 is preferably adjustable depending on the type of material web and/or the desired heat output of the drying cylinder or the dryer section. It is also possible to vary the media pressure during the drying process.

Arranged in the interior of the overpressure cap 27 are a plurality, here a total of 6, feed inlets 35, out of which a pressurized liquid or gaseous medium, for example, air, can be blown into the pressure chamber 29, as indicated with arrows. The temperature of the gaseous medium, hereinafter referred to briefly as "gas" is, for example, within a range of 40° C. to 80° C. The temperature of the gas is, in principle, lower than the temperature on the outside of the partial circumference of the drying cylinder 3 surrounded by the material web 9 and the support bands 5, 7 and, accordingly, can also be 20° C. or 100° C., for example. The pressure and the temperature of the gas blown into the pressure chamber 29 is arbitrarily variable, preferably adjustable, for example, depending on the temperature of the drying cylinder 3. The internally heated drying cylinder 3 has a temperature which is preferably in a range from 140° C. to 190° C. The drying cylinder 3 may be heated by steam, oil, water, an infrared device, combustible gases, or the like. Independent of the heating of the drying cylinder 3, the introduction of heat to the outside of the drying cylinder 3, i.e., on the cylinder surface, can be precisely adjusted. Consequently, it is possible to heat the drying cylinder 3 over its circumference or along its length such that the outside of the drying cylinder 3 has different temperatures.

The material web 9 is pressed against the circumference of the drying cylinder 3 by the pressurized gas such that the drying contact and thus the heat transfer both from the drying cylinder 3 to the material web 9 and also within the material web 9 is increased. The gas further serves to cool both the support bands 5, 7 and the material web 9 on the side turned away from the drying cylinder 3. This establishes a temperature drop from the heated drying cylinder 3 in the direction of the support bands 5, 7. This establishes both the preferred discharge direction of the liquid leaving the material web 9 partially as vapor and partially as liquid, possibly increases the heat flow as well. After the vapor leaves the material web 9, it precipitates directly as condensate in the support bands 5, 7 and is absorbed thereby. The temperature of the second support band 7 guided on the outside is lower, at least in zones, than the temperature of the first support band 5 adjacent to the material web 9. The liquid leaving the material web 9 thus precipitates for the most part or completely in the second support band 7 positioned on the outside, which has—as already described—a coarser structure than the first support band 5 adjacent to the material web 9.

A relief zone 37 which has a plurality of pressure zones 39, 40, 41, here a total of three, is provided in the pressure chamber 29 of the overpressure cap 27. The relief zone 37 serves to prevent an excessive and/or overly rapid drop in pressure when the material web 9 leaves the pressure chamber 29, which could result in destruction of the paper web 9 by delamination. Moreover, the pressure drop at the outlet of the pressure chamber 29 may be expediently adjusted. In the exemplary embodiment depicted in FIG. 1, the pressure zones 39, 40, 41 are each formed by a chamber 43 provided with at least one flow channel. The pressure drops in the direction of travel of the material web 9 from one pressure zone to the next, i.e., the pressure is lower in the pressure zone 39 than in the pressure chamber 29 and higher than in the following pressure zone 40. The pressure in the pressure zones 39, 40, 41 is adjusted, as indicated with arrows 45, precisely by the openings provided in the chambers 43. For the discharge of the liquid condensed in the support bands 5 and 7, the pressure zone 41, sealed relative to the pressure chamber 29 by seals 33' and 33", is in flow connection with the surroundings by way of a port 47 introduced into the housing 28 of the overpressure cap 27.

The support bands 5, 7 run through the pressure zones 39, 40, and 41 along with the material web 9 adjacent to the drying cylinder 3. After the discharge of the material web 9 from the drying cylinder 3, the web is guided by a deflecting roller 48 to a downstream part of the paper production machine, while the support bands 5, 7 are guided by the guide rollers arranged in the interior of the overpressure cap to the intake zone. In this process, the support bands run through the pressure zone 41 in which the gas is passed through the support bands. Thus, the liquid absorbed by the support bands 5, 7 is blown out and they are thus dried. The support bands may also be dried, for example, by vacuum aspirators (extraction pipes). The liquid is collected in a container 49 arranged outside the overpressure cap 27 and discharged from there along with the liquid.

Figure 2:
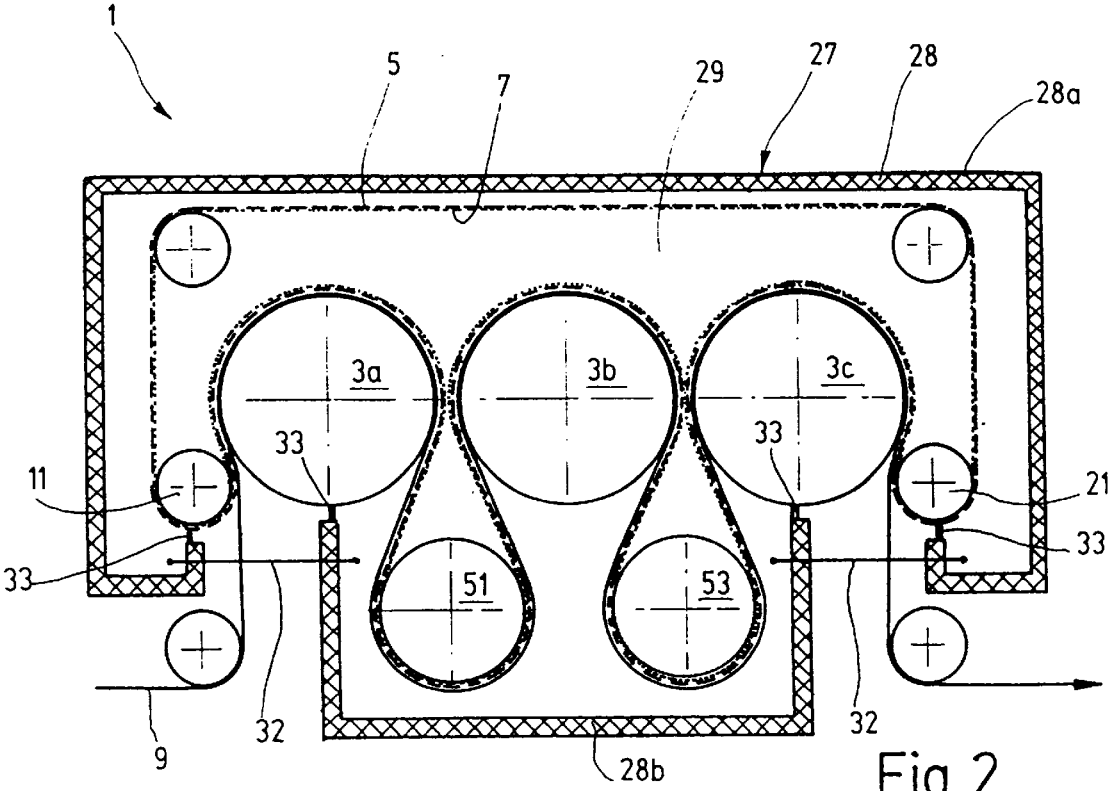
FIGS. 2 and 3 in each case, a schematic view of a portion of another exemplary embodiment of the dryer section.

FIG. 2 depicts schematically a portion of another embodiment of the dryer section 1 in a side view, namely a single-row drying group which includes a plurality of drying cylinders 3*a*, 3*b*, and 3*c*, here a total of three, as well as two web guide rollers 51 and 53. Parts which correspond to those in FIG. 1 are provided with the same reference characters, so reference is made in that regard to the description of FIG. 1. In the following, only the differences will be dealt with in detail. The overpressure cap 27 has a multi-part housing 28 that includes a first housing part 28*a* and a second housing part 28*b* which substantially surround the drying cylinders 3*a*, 3*b*, 3*c* and the web guide rollers 51 and 53. The pressure chamber 29 of the overpressure cap 27 is sealed against the surroundings by both the guide rollers 11 and 21 and by seals 33. The guide roller 11 forms a nip with the first drying cylinder 3*a* or is arranged at a small distance therefrom, and the guide roller 21 forms a nip with the drying cylinder 3*c* or is arranged at a small distance therefrom. The material web 9 and the support bands 5, 7 are guided through the respective nip or gap between a roller and a drying cylinder. The sealing strips 33 installed on the second housing part 28*b* work directly, with or without contact, in coordination with the outside, i.e., a circumferential zone of the drying cylinders 3*a*, 3*c* which is surrounded neither by one of the support bands 5, 7 nor by the material web 9. The sealing strips 33 installed on the first housing part 28*a* work, with or without contact, in coordination with the circumferential zone of the guide rollers 11 and 21 surrounded by the support bands 5, 7.

As is discernible in FIG. 2, the support bands 5, 7 are guided along with the material web 9 meanderingly over the drying cylinders 3*a*, 3*b*, 3*c* and the web guide rollers 51, 53. Because the overpressure cap 27 and the support bands 5, 7 are associated with a plurality of drying cylinders, the structure of the dryer section can be simplified.

Figure 3:
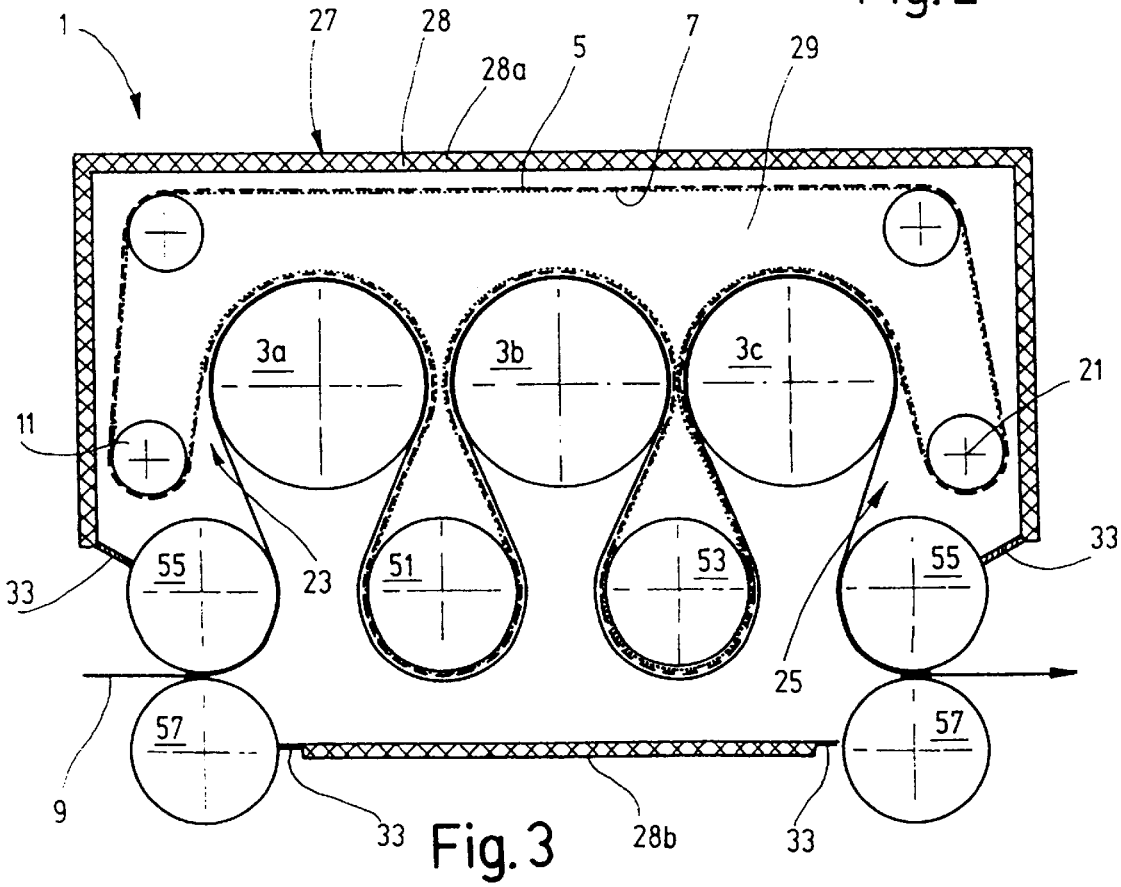

FIG. 3 depicts schematically a sketch of the principle of a third exemplary embodiment of a dryer section 1. Identical parts are provided with identical reference characters, so reference is made in that regard to the description for FIG. 2. The pressure chamber 29 is sealed relative to the surroundings here in the zone of the material web 9 by two roller arrangements, each of which includes two rollers 55 and 57. Between the rollers 55, 57 arranged at a distance from each other, either a small intermediate space is provided or they are preferably designed as pressing rollers, i.e., the rollers 55, 57 make contact with each other on their circumference along a clamping pressure-contact line and form a press nip through which the material web 9 is guided. Alternatively, it is possible that one or both rollers 55, 57 are designed as so-called shoe presses. The pressure chamber 29 between the housing 28 and a rollers 55, 57 is sealed by means of sealing strips 33, which work directly in coordination with the surface of the rollers 55 and 57.

The guide rollers 11 or 21 arranged in the intake zone 23 in which the material web 9 runs onto the first drying cylinder 3*a* and in the discharge zone 25, in which the material web 9 runs off the last drying cylinder 3*c*, are arranged here at a distance from the drying cylinders 3*a*, 3*c* and do not serve to seal the pressure chamber 29, but only to guide the support bands 5, 7.

Figure 4:
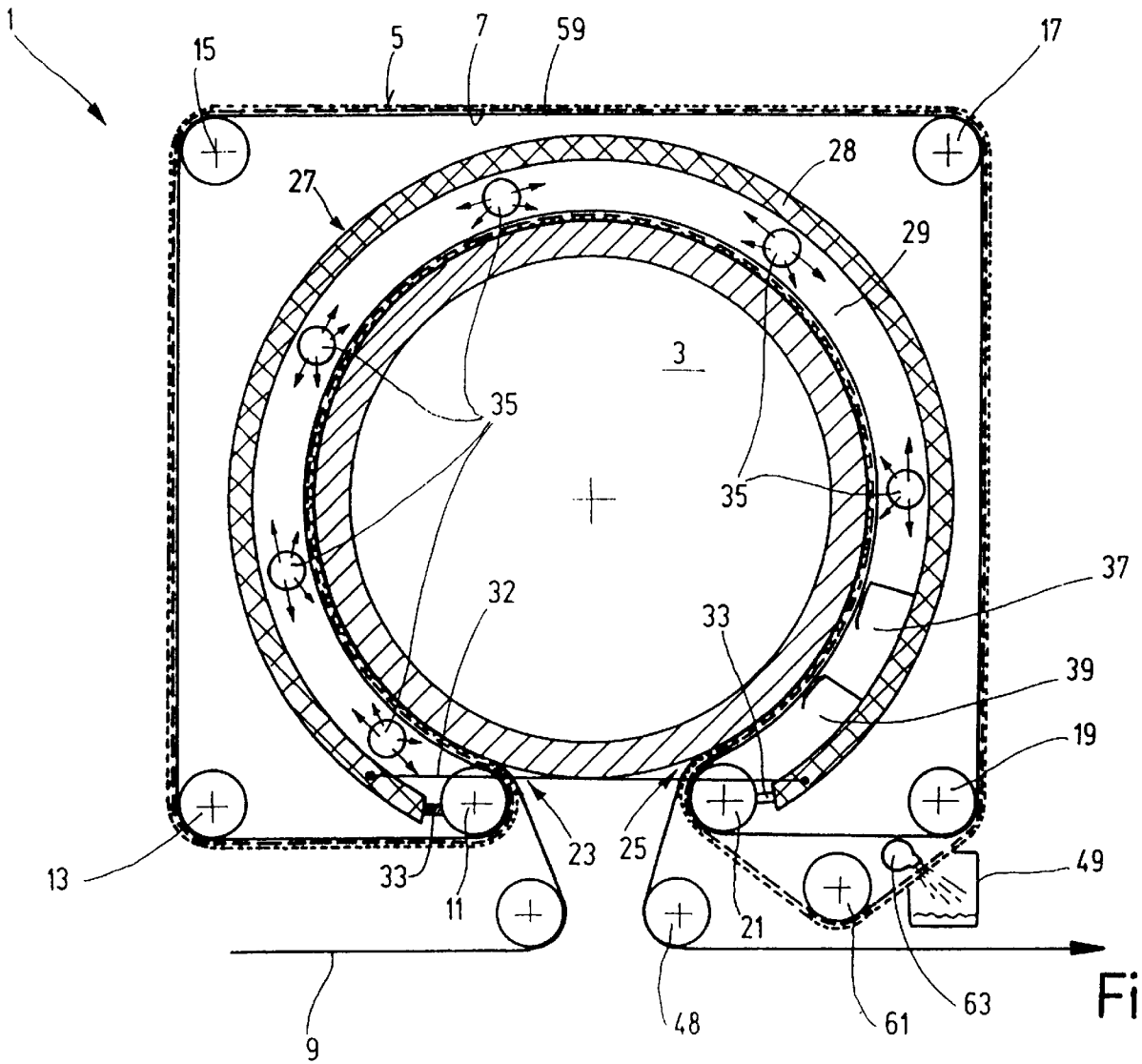
FIG. 4 a detail from a fourth exemplary embodiment of the dryer section.

FIG. 4 depicts schematically a detail of an embodiment of a dryer section, namely an overpressure box 27 in a side view. Parts which correspond to those in FIG. 1 are provided with identical reference characters, so reference is made in that regard to the description for FIG. 1. The material web 9 is guided around the drying cylinder 3 along with the support bands 5, 7 and a gas-impermeable sealing band 59 positioned on the outside. The sealing band 59 is adjacent to the second support band 7 such that the support bands 5, 7 and the material web 9 are not in direct contact with the medium located on the opposite side of the sealing band 59 in the pressure chamber 29 of the overpressure cap 27. Via sealing band 59, made, for example, of at least one metal, for example, of steel, the gas pressure adjacent to it on the outside can be precisely transferred to the second support band 7 such that the pressing of the material web 9 on the circumference of the drying cylinder 3 is increased. The pressing force acting on the material web 9 which, without the sealing band 59, is caused merely by the pretensioning of the support bands 5, 7, can thus be increased by the pressurized gas. By an increase in the pressure of the medium in the pressure chamber 29, i.e., in this exemplary embodiment, the gas pressure, such high pressing forces can be applied to the material web 9 by way of the sealing band 59 and the support bands 5, 7, as can only be obtained otherwise—if at all—with high pretensioning of the support bands 5, 7. Using a pressurized medium, even higher pressing forces can be generated than can be obtained with pretensioning of the support bands, whose maximum longitudinal stress is relatively low and limited by the properties of the support band material. By the high pressing forces, the properties of the material web can be clearly improved; in particular, a compacting of the material web occurs with high pressing forces. Via sealing band 59, it is thus possible to apply a high pressure or high pressing force to the material web 9, which is advantageous, for example, in producing packaging papers. The material from which the sealing band 59 is made preferably has good heat conductivity.

A chamber is delimited by the circumference of the drying cylinder 3 and the sealing band 59 guided over the drying cylinder 3, inside which the material web 9 and, in the exemplary embodiment depicted in FIG. 4, the support bands 5, 7 are arranged during their circulation over the drying cylinder 3. In an especially preferred variant embodiment, provision is made for this chamber to be sealed using a seal not shown in FIG. 4 relative to the overpressure cap 27 including here only one pressure chamber 29. By the complete sealing of the chamber relative to the overpressure cap by the sealing band from above, by the drying cylinder from below, and on the sides by the seal, penetration of the preferably liquid but possibly gaseous medium used for cooling of the sealing band 59 and thus moistening of the material web is prevented. Preferably, in all exemplary embodiments of the dryer section in which such a sealing band 59 is used, this chamber delimited by the circumference of the drying cylinder and the sealing band itself is sealed on the sides by a seal relative to the overpressure cap or its pressure chamber/pressure chambers. The design of the seal may be selected arbitrarily.

In the exemplary embodiment depicted in FIG. 1, the sealing band 59 is cooled by the pressurized medium, by which the second support band 7 adjacent to the sealing band 59 is in turn cooled. This establishes a temperature drop in the heated drying cylinder 3 in the direction of the sealing band 59 which in turn results in increased heat transfer from the drying cylinder 3 to the material web 9. The liquid leaving the material web 9 partially as vapor penetrates the porous first support band 5 and precipitates preferably as condensate in the second support band 7, which is cooler compared to the first support band 5, and is absorbed thereby.

As already described above, the pressing force which presses the material web 9 onto the circumference of the drying cylinder 3 is composed of the forces generated by the pretensioning of the support bands 5, 7 and the pressurized gaseous medium. The magnitude of the forces generated by the pretensioning of the support bands and the gas pressure or their proportion in the pressing force may be chosen arbitrarily, preferably adjusted, for example, depending on the requirements imposed on the material web to be produced.

As is discernible in FIG. 4, the support bands 5, 7 and the sealing band 59 are guided over guide rollers 11 through 19, 61 and 21, which are arranged outside the overpressure cap 27. This ensures good accessibility to the guide devices of the bands, i.e., the guide rollers in this case. Moreover, the design of the overpressure cap 27 can be simplified.

In the exemplary embodiment depicted in FIG. 4, the sealing band 59, the support bands 5, 7 and the material web 9 are guided out of the pressure chamber 29 through the nip in the discharge zone 25 between the guide roller 21 and the drying cylinder 3. The material web 9 is guided further over a deflecting roller 48 to a downstream zone of the paper production machine. The sealing band 59 is guided directly from the guide roller 21 to the guide roller 19, while the support bands 5, 7 are guided first to the guide roller 61 and from there to the guide roller 19. In the zone between the guide rollers 21 and 19 is arranged a blowing device 63 which impinges upon the support bands 5, 7 with a gaseous medium, by which the liquid absorbed by the support bands 5, 7 during circulation around the drying cylinder 3 is blown out. The liquid is caught in a container 49 which is arranged on the material web side opposite the blowing device 63. Then, the support bands 5, 7 and the sealing band 59 are guided together in the zone of the guide roller 19 and are guided together over the guide rollers 17, 15, 13, and 11 to the drying cylinder 3.

In an advantageous exemplary embodiment, provision is made for a first support band 5 having a fine structure and the second support band 7 having a coarser structure compared to the first support band 5 to be connected to each other, for example, glued or woven, to form one support band. In another exemplary embodiment, the support bands 5, 7 and a sealing band 59 are connected to each other and form a single support/sealing band. In another exemplary embodiment, provision is made for only the second support band 7 and the sealing band 59 to be connected to one another. From all this, it is clear that even more than three bands, for example, four bands, or two bands, for example, a support band and a sealing band, can be used, with which the functions of the support bands 5, 7 and/or the sealing band 59 can be realized.

In the exemplary embodiments described with reference to FIG. 1 through 4, the material web 9 lies directly on the outside or the surface of the drying cylinder. In another exemplary embodiment, provision is made for a wire to be guided between the material web 9 and the drying cylinder 3. In this manner, the adhesion of the moist material web 9 on the drying cylinder can be reduced such that it can be relatively easily released from the drying cylinder 3.

It is readily clear that the exemplary embodiments of the overpressure cap described with reference to FIG. 1 through 4 can also be used within a refining machine, for example, a coating machine. To cool a band, provision is made in an advantageous variant embodiment to provide a liquid, preferably water, which is pressurized at preferably 0.001 bar absolute to 12 bar absolute and is introduced into the pressure chamber 29.

In summary, it should be noted that through the cooling of the bands/band guided along with the material web 9 over the drying cylinder 3 and/or the material web 9 by the pressurized, preferably liquid, but possibly gaseous medium, the drying performance of a dryer section can be increased. It is especially advantageous that existing dryer sections can be retrofitted relatively simply with the support bands 5, 7 and/or the sealing band 59.

Figure 5:
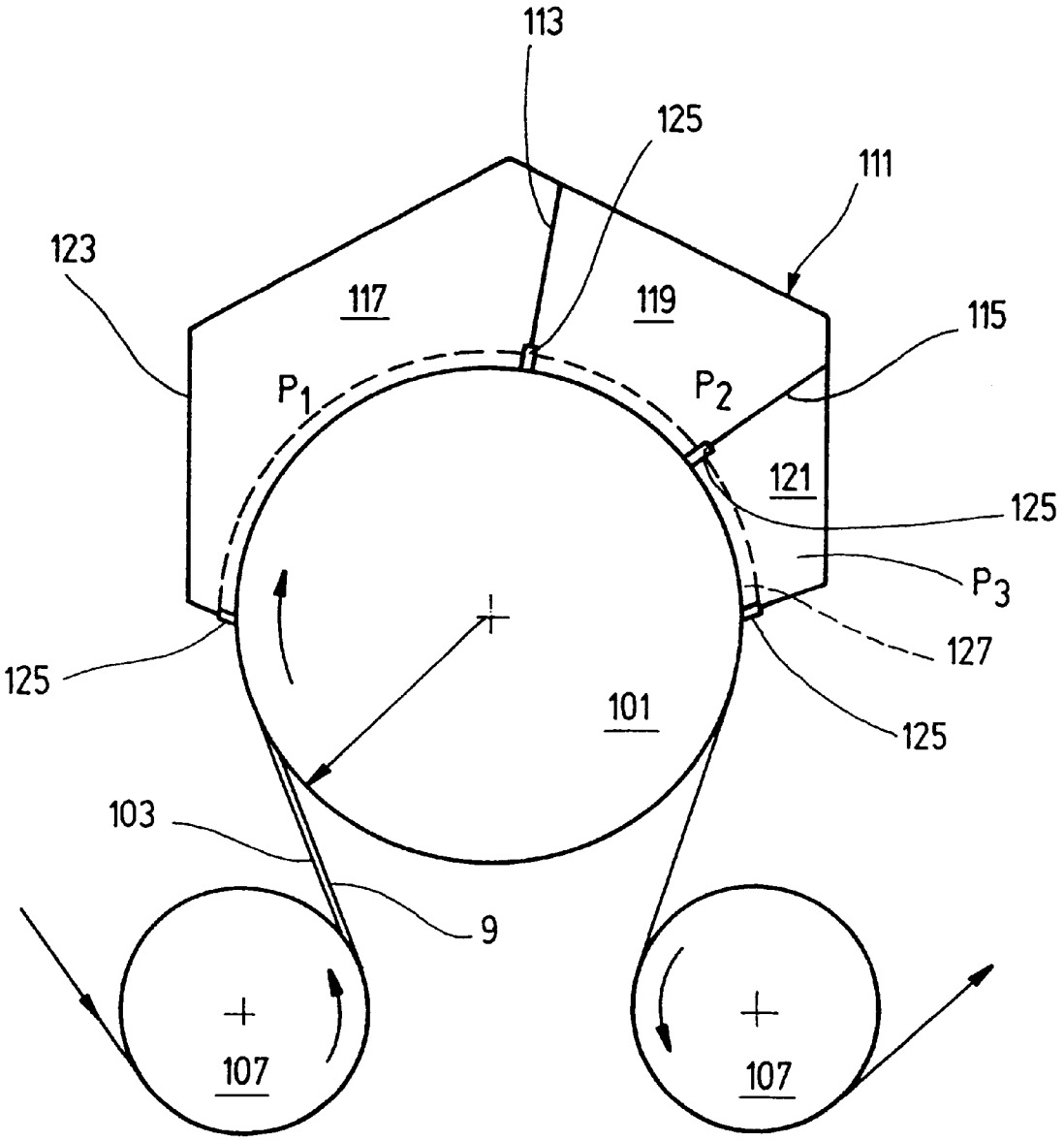
FIG. 5 depicts a sketch of the principle of a fifth exemplary embodiment of a pressing device designed as an overpressure cap.

In the following, additional exemplary embodiments of an overpressure cap are explained in detail with reference to FIGS. 5 through 7, and, in fact, FIG. 5 depicts schematically a drying cylinder 101 in an end view. In this exemplary embodiment, only one support band 103, designed as a wire, for example, is guided along with a material web 9, for example, a paper web, over a circumferential zone of the drying cylinder 101. In order to enlarge the contact area between the heated surface of the drying cylinder and the material web to be dried, deflecting rollers 107, whose rotational direction depends on the direction of travel of the material web and is indicated here by arrows, are provided in the feed, or intake, zone and in the discharge zone of the drying cylinder.

The material web 9 is adjusted to improve the heat transfer from the drying cylinder 101 to the material web by a predefined support band tension. In order to improve the drying contact with the surface of the drying cylinder 101, a pressing device, designed here as an overpressure cap 111 is provided, which preferably extends over the entire length of the drying cylinder 101.

The overpressure cap 111 has a plurality of interior walls 113 and 115, which preferably extend along the entire length of the overpressure cap and which delimit a plurality of, in this case three, overpressure chambers 117, 119, 121. In the overpressure chambers, a pressure level is adjusted in a suitable manner, for example, by feeding in a gaseous medium, for example, air, or preferably a liquid medium, preferably water, based on which the support band 103, and thus the material web 9, is pressed against the surface of the drying cylinder 101, such that improved heat transfer results. The pressure levels $p_1$, $p_2$, $p_3$ in the overpressure chambers 117, 119, and 121 can be adjusted to desired values in order to ensure optimal drying behavior of the material web. The pressure levels can be set, for example, according to the inequality $p_1<p_2>p_3$ or according to the inequality $p_1>p_2>p_3$.

In addition, a subdivision of the overpressure chambers may be made in the longitudinal direction, i.e., over the width of the material web 9, in order to be able to set different pressure values at right angles to the direction of travel of the material web.

The longitudinal edges of the housing 123 of the overpressure cap 111 adjacent to the surface of the drying cylinder 101 are, like the longitudinal edges of the partitions 113 and 115 facing the circumferential surface of the drying cylinder 101, provided with sealing strips 125, which largely prevent a pressure loss from the pressure chambers. Instead of the sealing strips 125, so-called air knives, by which contact-free sealing of the overpressure chambers can be realized, may also be used. The housing 123 is moreover provided on the end and on the opposite back end with sealing strips 127, which are indicated here by broken lines.

It is possible to adjust the pressure relationships of the overpressure cap 111 by the sealing behavior of the sealing strips 125 and 127. For example, a smooth pressure transition may be obtained in the overpressure chambers 117, 119, and 121 in that the sealing strips 125 provided on the interior walls 113 and 115 permit a media transfer and thus pressure equalization. Also, pressure equalization may be desirable upon intake and discharge of the material web 9 into and out of the overpressure cap in order to ensure a smooth pressure transition here as well.

Finally, it is also possible to design the sealing strip 127 provided on the front end and the back end of the housing 123, such that pressure equalization is possible here as well, to obtain a smooth pressure transition. Thus, the edge of the material web 9 is pressed with less pressure against the drying cylinder 101, which counteracts overdrying of the edges of the web.

Figure 6:
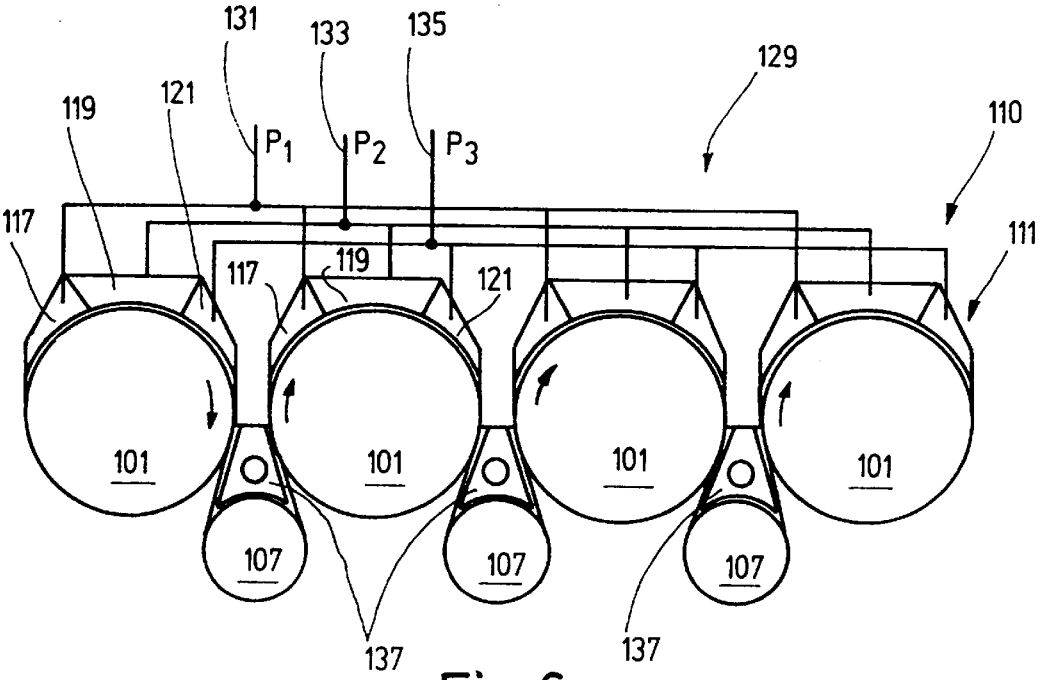
FIGS. 6 and 7 in each case, a schematic view of the end of another embodiment of the dryer section, and FIGS. 8–12 in each case, a detail of a variant embodiment of the dryer section in a side view.

FIG. 6 very schematically depicts the front end of another exemplary embodiment of a dryer section 110, which has a plurality of drying cylinders 101 positioned next to one another. In the exemplary embodiment depicted here, a pressing device designed as an overpressure cap 111 is associated with each individual drying cylinder. Each of the overpressure caps has three overpressure chambers 117, 119, and 121. The chambers are impinged upon through lines 129 with a pressurized gaseous or liquid medium, such that the pressure medium is fed over a first connecting line 131 at a pressure level $p_1$, with which each pressure chamber 117 is impinged upon. The central overpressure chamber 119 of the overpressure caps 111 is impinged upon by way of a second connecting line 133 with a pressure level $p_2$. And finally, a pressure level $p_3$ is fed to the overpressure chambers 121 of the overpressure caps 111 by way of a third connecting line 135.

From all this, it is clear that identical pressure level sequences $p_1$, $p_2$, and $p_3$ are fed into all overpressure caps such that the same pressing forces act everywhere.

In the dryer section 119 depicted here, the support band 103 and the material web 9 are guided meanderingly over drying cylinders 101, between which deflecting rollers 107 are arranged in each case. Between each two drying cylinders, an external suction box 137 is arranged in each case, by which the medium entrained by the material web is suctioned off, but especially guidance of the material web is also ensured.

Figure 7:
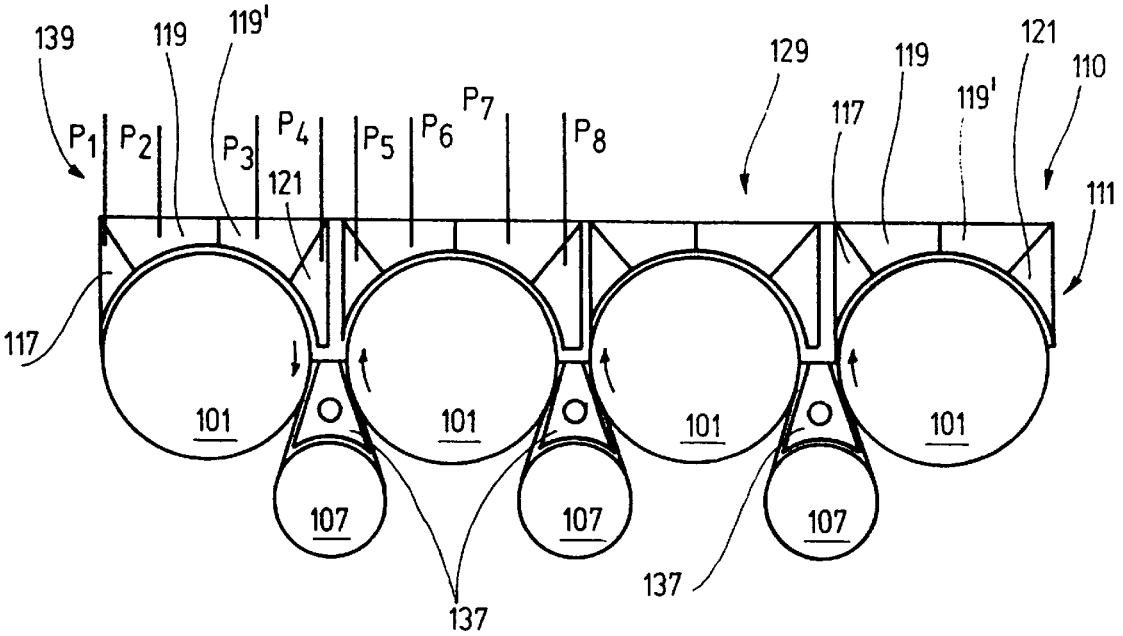

FIG. 7 depicts schematically an end view of an additional exemplary embodiment of a dryer section 110, of which, purely by way of example, four drying cylinders 101 are shown. Again, deflecting rollers 107 are provided between each two drying cylinders, such that the support band 103 and material web 9 can be guided meanderingly over the drying cylinders 101. By the tractive force of the support band 103, the material web 9 is pressed against the heated surface of the drying cylinders. In addition, pressing devices designed as overpressure caps are provided for each drying cylinder here as well. However, the overpressure caps here each have four overpressure chambers 117, 119, 119', and 121 which, in each case, are supplied by separate pressure lines 139 with an overpressurized, preferably liquid, medium.

By the labeling of the pressure levels $p_1, p_2 \ldots p_8, \ldots$ in the various overpressure chambers, FIG. 7 indicates that all overpressure chambers of all overpressure caps 111 can have their own pressure level independently of the other overpressure chambers. With such a design of the dryer section 110, it is thus possible to set differing pressing forces along the travel direction of the material web 9, and thus to ensure individual drying behavior.

With the embodiment of the dryer section 110 depicted in FIG. 7, suction boxes 137 are also provided between each two drying cylinders 101. The suction boxes 137 are connected to an appropriate vacuum source, for example, to a vacuum pump, which is not depicted here. The exhaust air of the suction boxes or the vacuum pumps can be dried by downstream aggregates and possibly heated and then fed to the overpressure chambers.

From all this, it is clear that the pressing forces can be adjusted quite variably. It has been demonstrated that even with a very low overpressure of, for example, 0.05 bar, it is possible to obtain an additional pressing pressure action which corresponds roughly to a doubling of the current maximum customary wire pressure forces. In other words, the pressing forces can be very effectively increased with a pressing device designed as an overpressure cap.

From the explanations of FIGS. 1 through 7, it is discernible that the pressing forces are adjustable to the desired values not only over the circumference of the drying cylinders, but also along their lengths. Thus, the heat transfer with in the dryer section can be adjusted individually. Moreover, it is possible, by setting a differential pressure rise at the intake into the dryer section, to seal off an air cushion based, for example, on entrained air, and also to positively influence the drying characteristics by means of improved heat transfer. Thus, this special advantage can be obtained without additional measures.

With the exemplary embodiments according to FIGS. 5 through 7, it is readily possible for the temperature of the pressurized, preferably liquid, medium which is introduced into the overpressure chambers 117, 119, 119', and 121, to be lower than the temperature on the outside of the partial circumference of the drying cylinder 101 surrounded by the material web and the at least one support band. Thus, a temperature drop from the heated drying cylinder 101 in the direction of the support band is established, such that both the heat flow can be increased and the discharge direction of the liquid leaving the material web. Moreover, it is possible for different pressure media to be introduced into the overpressure chambers 117, 119, 119', and 121, such that the temperature of the liquid or gaseous medium can be different from one overpressure chamber to the next. Thus, a different heat flow can be set on one drying cylinder over its circumference.

In an advantageous variant embodiment of the exemplary embodiment explained with reference to FIGS. 5 through 7, provision is made for the material web 9 to be guided along with at least two support bands and/or one medium-impermeable sealing band 9 over a circumferential zone of one or a plurality of drying cylinders 101. The support bands may have different structures (coarse/fine). Moreover, the support bands may be connected to one another and/or to the sealing band, or one of the support bands may be connected to the sealing band.

From all this, it is readily clear that, even with an overpressure cap 27 described with reference to FIGS. 1 through 4 with appropriate means, the pressure chamber 29 can be subdivided into at least two overpressure chambers, viewed in the circumferential direction and/or in the longitudinal direction of the drying cylinder, such that the same advantages are established as in the overpressure cap 111 described in FIGS. 5 through 7.

It is common to all the exemplary embodiments that the temperature of the medium introduced into the pressure chamber 29 or into the overpressure chambers 117, 119, 119' and/or 121 is lower than that on the outside of the drying cylinder and that the medium is pressurized, preferably within a range from 0.001 bar through 12 bar. Especially preferred it is a liquid pressure medium, especially water, since with a liquid, as opposed to a gas, a higher pressure can be realized with lower flow. Via the resultant economic advantages, the costs of the dryer section can also be reduced.

The above-described sealing band 59 may be made of any material, preferably a material with good heat conductivity. In an advantageous embodiment, the sealing band is made of at least one metal, for example, steel, which also has, among other things, good strength properties in addition to good heat conductivity.

In the following, additional variant embodiments of the dryer section are explained in detail with reference to FIGS. 8 through 12. Identical parts are provided with identical reference characters, so reference is made in that regard to the description for the preceding FIGS. 1 through 7. Overpressure caps 27, each including a pressure chamber 29, are associated with the drying cylinders of the dryer section purely by way of example. Moreover, in all exemplary embodiments, the material web 9 is guided along with the first and second support bands 5, 7 as well as one sealing band 59 over a circumferential zone of the drying cylinders. Obviously, different guidance variants described above are also possible, for example, for the material web 9 to be pressed by only one single support band against the circumference of the drying cylinder.

Figure 8:
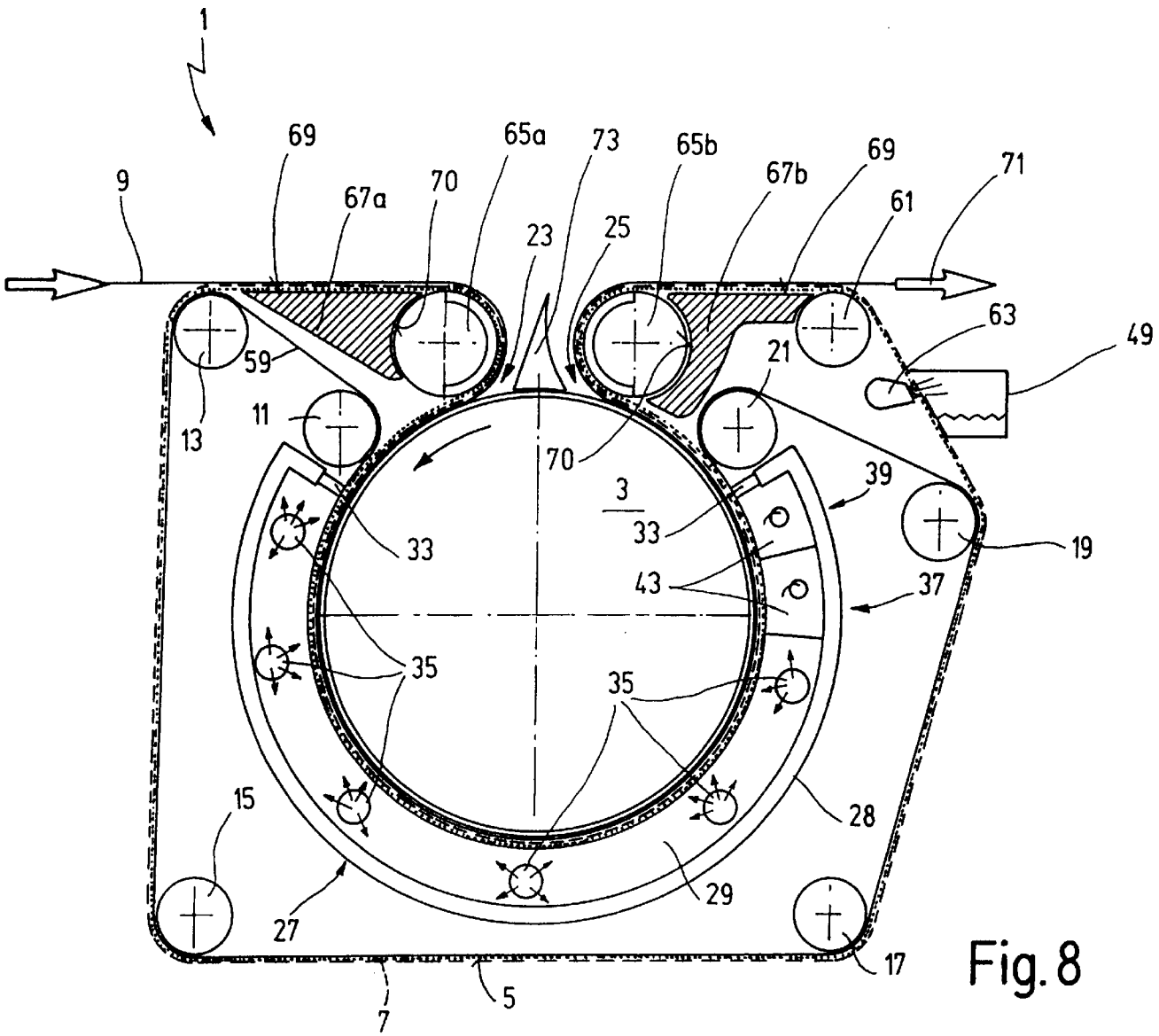

FIG. 8 depicts a modified embodiment of the dryer section 1 depicted in FIG. 4. In the following, only the differences are dealt with in detail. In the exemplary embodiment depicted in FIG. 8, which is rotated by 180° relative to that in FIG. 4, suction rollers 65*a* and 65*b* are provided, which are arranged with a relatively small distance between them and in each case form a nip with the drying cylinder 3. The structure and the design of the suction rollers discussed here are known in the art, so these are not described in detail. The support bands 5, 7 and the material web 9 are guided together through the nip formed by the suction rollers. Suction boxes 67*a* and 67*b*, which can be impinged upon by a vacuum and which are located inside the closed loop of the support bands 5, 7 and here are designed substantially identical, are associated with the suction rollers 65*a*, 65*b*. The suction box 67*a*, arranged in the intermediate space between the suction roller 65*a* and the guide roller 13, has a first, straight wall section 69 and a second wall section 70 adapted to the curve of the suction roller, to which suction can be applied. In the zone of the first wall section 69, over which only the support bands 5, 7 are guided, the material web guided in from an upstream part of the machine is sucked onto the first support band 5 and guided along with the support bands over the suction roller 65*a* into the nip between it and the drying cylinder 3.

A guide roller 11, over which the sealing band 59 separated from the support bands 5, 7 is guided in the zone of the guide roller 13, forming a nip with the drying cylinder 3, is located downstream from the suction roller 65*a*, viewed in the travel direction of the material web. The sealing band 59 with the support bands 5, 7 and the material web 9 are guided together in the nip between the guide roller 11 and the drying cylinder 3, i.e., before the material web and the bands are guided into the pressure chamber 29 of the overpressure cap 27. After the material web 9 and the bands are guided over a circumferential zone of the drying cylinder 3, in contact therewith on a guide roller 21 forming a nip with the drying cylinder, the sealing band 59 adjacent to the second support band 7 is separated therefrom and guided back over guide rollers 19, 17, 15 to the guide roller 13. The material web adjacent to the outside circumference of the drying cylinder 3 and the support bands 5, 7 are again guided to the discharge zone 25, where they are lifted off the drying cylinder 3 and deflected by the suction roller 65*b*. The material web and the support bands 5, 7 are guided together over a first, straight wall section 69 of the suction box 67*b*, which can be impinged upon at least in sections by a vacuum, to hold the material web on the first support band. On the guide roller 61 downstream from the suction box 67*b*, the material web is separated from the first support band 5 and guided farther to a downstream device (not shown) of the machine (arrow 71), while the support bands 5, 7 are guided over the guide roller 61 to the guide roller 19, over which the sealing band 59 is also guided. From the guide roller 19 the support bands 5, 7 as well as the sealing band 59 adjacent to the second support band 7 arrive over the guide rollers 17 and 15 to the guide roller 13. In the zone between the guide rollers 61 and 19, the two support bands 5, 7 are impinged upon with a gaseous medium such that the liquid which left the material web and was absorbed by the support bands is blown out here or, in a different exemplary embodiment (not shown), suctioned out.

With the help of the guide device (suction box, suction roller) provided in the transfer zone in which the material web is transferred from a part of the machine upstream from the drying cylinder 3 to the support bands 5, 7 and transported to the intake zone 23, and the guide device (suction box, suction roller) provided in the discharge zone 25 as well as the acceptance zone following it, in which the material web is further guided to a downstream part of the machine, good adhesion of the material web on the support bands 5, 7 and thus reliable guidance are ensured. By the good adhesion of the material web on the support bands, shrinkage of the material web during the drying process, which can result in an undesired material web cross-section, is also prevented. By using the devices which can be impinged upon by vacuum in the transfer and acceptance zone or intake zone 23 and discharge zone 25 of the drying cylinder 3, it is possible, even at high machine speeds, to guarantee reliable guidance of the material web 3, especially by a device upstream from the drying cylinder 3. Instead of the suction boxes 67*a*, 67*b*, the suction rollers 65*a*, 65*b* can also be subjected to suction from the outside by at least one of their journal pins (not shown in FIG. 8).

In the exemplary embodiment depicted in FIG. 8, a known doctor 73 is also provided, which is arranged in the intermediate space between the suction rollers 65*a* and 65*b* and which works in coordination with the surface of the drying cylinder 3. The doctor 73 prevents repeated pulling of the material web into the nip between the suction roller 65*a* and the drying cylinder 3 upon start-up of the machine or in the event of a break in the paper web. In this exemplary embodiment, the housing 28 of the overpressure cap 27 associated with the drying cylinder 3 has on its two ends one sealing strip 33 each, which can be pressed against the sealing band 59 guided on the outside around the drying cylinder 3 or works in coordination therewith without contact. As already described above, the sealing strips 33 serve to seal the pressure chamber 29 of the overpressure cap 27.

Figure 9:
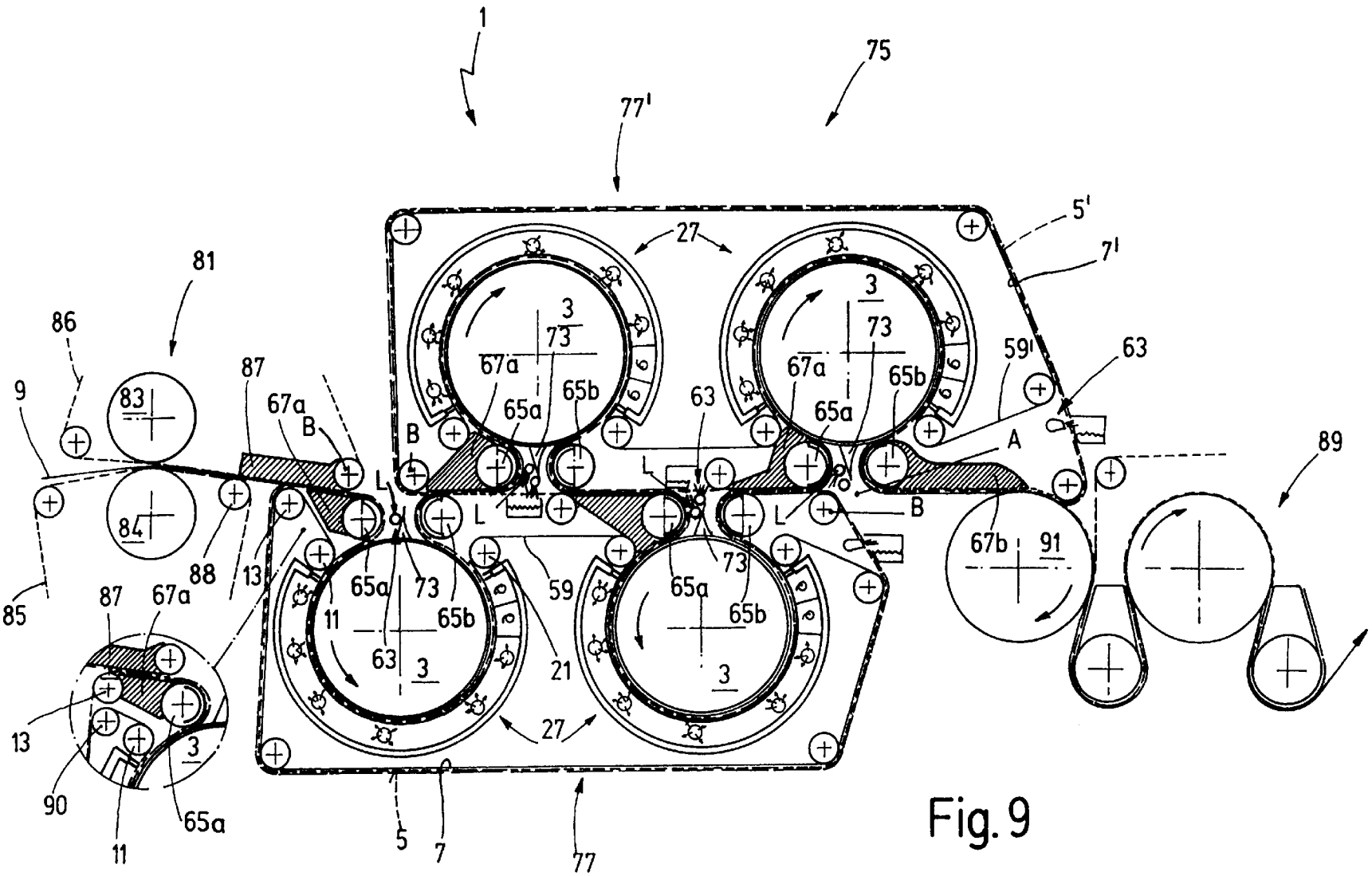

FIG. 9 depicts part of another exemplary embodiment of the dryer section 1, which includes a drying group 75 having a total of four drying cylinders 3 in this case. The first and third drying cylinders 3, viewed in the direction of travel of the material web 9, form a first, lower drying unit 77 and are arranged below the second and fourth drying cylinders 3, which form a second, upper drying unit 77', at a distance therefrom. An overpressure cap 27, having, purely by way of example, the same design as that described with reference to FIG. 8, is associated here with each of the drying cylinders 3. In each case, a first support band 5, a second support band 7, and a sealing band 59 or, respectively, 5', 7' and 59' are associated with the lower and the upper drying unit 77 or 77', respectively. In the intake zone 23, a suction roller 65*a*, which can be impinged upon by vacuum from an upstream suction box 67*a*, viewed in the direction of travel of the material web, is associated with each of the drying cylinders 3. In the discharge zone 25 of the drying cylinders 3, a suction roller 65*b* is provided in each case, such that here, for example, the suction rollers 65*b* associated with the first, second, and third drying cylinder can be subjected to a vacuum through at least one of their journal pins and the suction roller 65*b* associated with the fourth drying cylinder can be subjected to a vacuum with the help of a suction box 67*b*. Different types of application of suction are also possible.

The guidance of the support bands 5, 7 and 5', 7' is selected such that the material web 9 is guided in the transfer section between two drying cylinders 3 of the drying group 75 between the first support band 5 of the drying unit 77 and the first support band 5' of the drying unit 77, and, in fact, is guided in the zone of the straight section of the suction box 67*a* associated with the second drying cylinder 3, for example, over which the support bands 5', 7' and the sealing band 59' of the upper drying unit 77' are guided and guided past the support bands 5, 7 of the lower drying unit 77.

The web path is closed between the suction roller 65*b* associated with the first drying cylinder and the next guide device downstream in the direction of travel of the web associated with the second drying cylinder, here the suction box 67*a*. In connection with the present invention, the term "closed" web path means that the material web 9 is transported by a guide device (roller, suction box, or the like) to the next guide device, without the material web 9 running through an open path or the at least one support band, on which the material web lies, running through an open stretch. As is discernible in FIG. 9, the web path is closed inside the entire drying group 75. In a variant embodiment not shown in the figures, provision is made that the connection between the guide devices of the individual drying cylinders or the drying units can be arbitrarily released or closed. This makes it possible to protect the bands during run-up, i.e., during start-up of the machine and in the event of malfunctions. For this purpose, the deflecting/guide rollers labeled with "B" in FIG. 9 are, for example, appropriately designed to be movable.

In another exemplary embodiment of the drying group 75 depicted in FIG. 9, this includes only one or more than two drying units in line with each other. The drying cylinders of the drying group are arranged on an imaginary, preferably horizontal, plane. This makes it possible for all support and sealing bands of the drying group to be guided above or below the drying cylinder. Preferably, only one set of bands (support band/bands, sealing band) is associated with the drying cylinders of the drying group 75.

It is especially advantageous in the exemplary embodiment depicted in FIG. 9 for it to be possible, because of the guidance selected here of the support bands 5, 7, 5', 7' as well as of the sealing bands 59, 59', for the water collected in the support bands to be blown out after each drying cylinder 3 by a blowing device 63, which can preferably be attached to the doctor 73 of the opposing drying cylinder of the other drying unit, as depicted. For this, the sealing band is first separated from the support bands, runs through an open stretch and is then laid directly on the next drying cylinder of the same drying unit.

The doctors 73 are arranged in the intermediate space between the suction rollers 65*a*, 65*b*. In the event of malfunctions, in order to avoid unwanted pulling of a damaged or broken material web into the drying cylinder, additional blowing devices 63 are provided here, arranged in the zone of the doctor 73. The air streams emitted by these additional blowing devices are identified with an "L." Upon activation of the additional blowing device 63 (air streams L), the material web, mostly between the first support bands 5, 5', is guided to a zone of the drying group 75 identified with "A," which is located in proximity to the intake and discharge zone of the fourth drying cylinder 3. In the zone "A," the material web is guided downward out of the dryer section 1.

The press 81 upstream from the dryer section 1 includes rollers 83 and 84, between which a closed nip is formed. Furthermore, pressing felts 85, 86 are provided, between which the material web 9 is guided through the press nip. Because of the double-felted press, reliable guidance of the material web can be realized even at high machine speeds. A suction box 87, which lies in sections opposite the suction box 67*a*associated with the first drying cylinder 3 of the drying group 75, is arranged downstream from the press 81. As is discernible from FIG. 9, the pressing felt 85 is guided away downward after the beginning of the suction box 87 by a deflection roller 88, while the upper pressing felt 86 and the material web 9 are guided over a straight section of the suction box 87 which can be subjected to a vacuum. In the zone in which the suction boxes 87 and 67*a* overlap, the material web is sucked by the latter such that it adheres to the support bands 5, 7 guided over the suction box 67*a*. From all this, it is clear that the transfer of the material web from the press 81 to the first drying cylinder 3 can be carried out in an especially reliable and problem-free manner with the aid of the suction boxes 87, 67*a*.

In FIG. 9 a detail of an additional embodiment of the dryer section is depicted, enlarged inside a broken-line circle, namely the transfer zone between the press 81 and the first drying cylinder of the drying group 75. The sealing band 59 is guided here over an additional deflecting roller 90 to the guide roller 11, before the support bands 5, 7 are guided together with the material web 9 lying on the pressing felt 86 in the zone of the suction boxes 87, 67*a*.

A conventional single-row drying group 89 with a closed web path is arranged downstream from the dryer section 1 depicted in FIG. 9, viewed in the direction of travel of the material web, which here includes a plurality of drying cylinders, over which the material web 9 is guided meanderingly along with a support band also referred to as a transport band. The material web is guided after discharge from the last drying cylinder 3 of the drying group 75 over the straight section of the suction box 67*b* to the first drying cylinder 91 of the drying group 89. The web path between the suction box 67*b* and the drying cylinder 91 is closed. In another exemplary embodiment (not depicted in the figures), a conventional two-row drying group is arranged downstream from the dryer section 1, such that a closed connection of the drying group to the dryer section 1 for reliable transfer of the material web is possible here as well.

To reduce the remoistening of the material web 9 by the support bands 5', 7' filled with water after discharge from the last drying cylinder of the drying group 75, the first support band 5', with a finer structure, can be separated from the coarser second support band 7' before the transfer of the material web from the last drying cylinder 3 of the drying group 75 to the first drying cylinder 91 of the drying group 89 such that only the first support band 5' is used for the transfer of the material web 9. The second support band 5' can, for example, be guided back together with the support band 7' over an additional guide roller (not shown in FIG. 9) before the blowing or suction device 63 and dried along with it.

Figure 10:
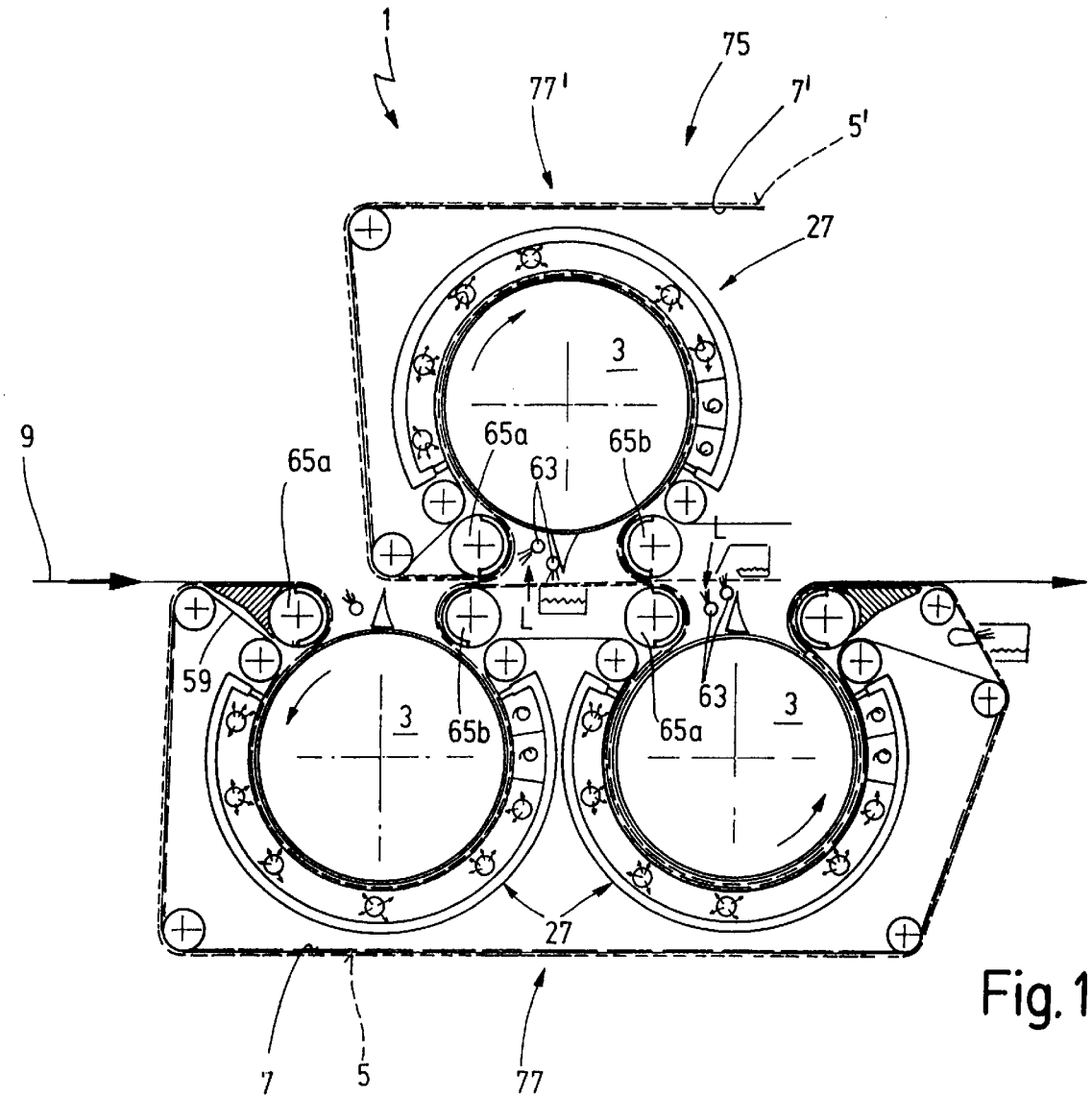

FIG. 10 depicts a portion of another exemplary embodiment of the drying group 75 depicted in FIG. 9. Identical parts are provided with identical reference characters, so reference is made in that regard to the description for the preceding figures. In the exemplary embodiment depicted in FIG. 10, straight transfer stretches between the lower drying unit 77 and the upper drying unit 77' are avoided, which is possible because of a shorter distance between the drying cylinders of the drying units 77, 77'. The suction roller **65*b* provided in the discharge zone of the first drying cylinder, over which the support bands 5, 7 and the material web 9 are guided together, forms a closed nip with the suction roller 65*a* provided in the intake zone of the second drying cylinder, over which the support bands 5', 7' of the drying unit 77 are guided. Here, the material web is thus transferred from the drying unit 77 to the drying unit 77' without the help of a suction box. Moreover, it is discernible from FIG. 10 that the suction roller 65*b* provided in the discharge zone of the second drying cylinder and the suction roller 65*a* provided in the intake zone of the third drying cylinder also form a closed nip. In an advantageous embodiment, provision is made for at least one of the suction rollers 65*a* and 65*b*** adjacent to one another to be movable, preferably pivotable, such that the connection between the two suction rollers, i.e., the nip, can be opened or closed. This makes it possible to protect the support bands upon start-up of the machine or in the event of malfunctions.

Figure 11:
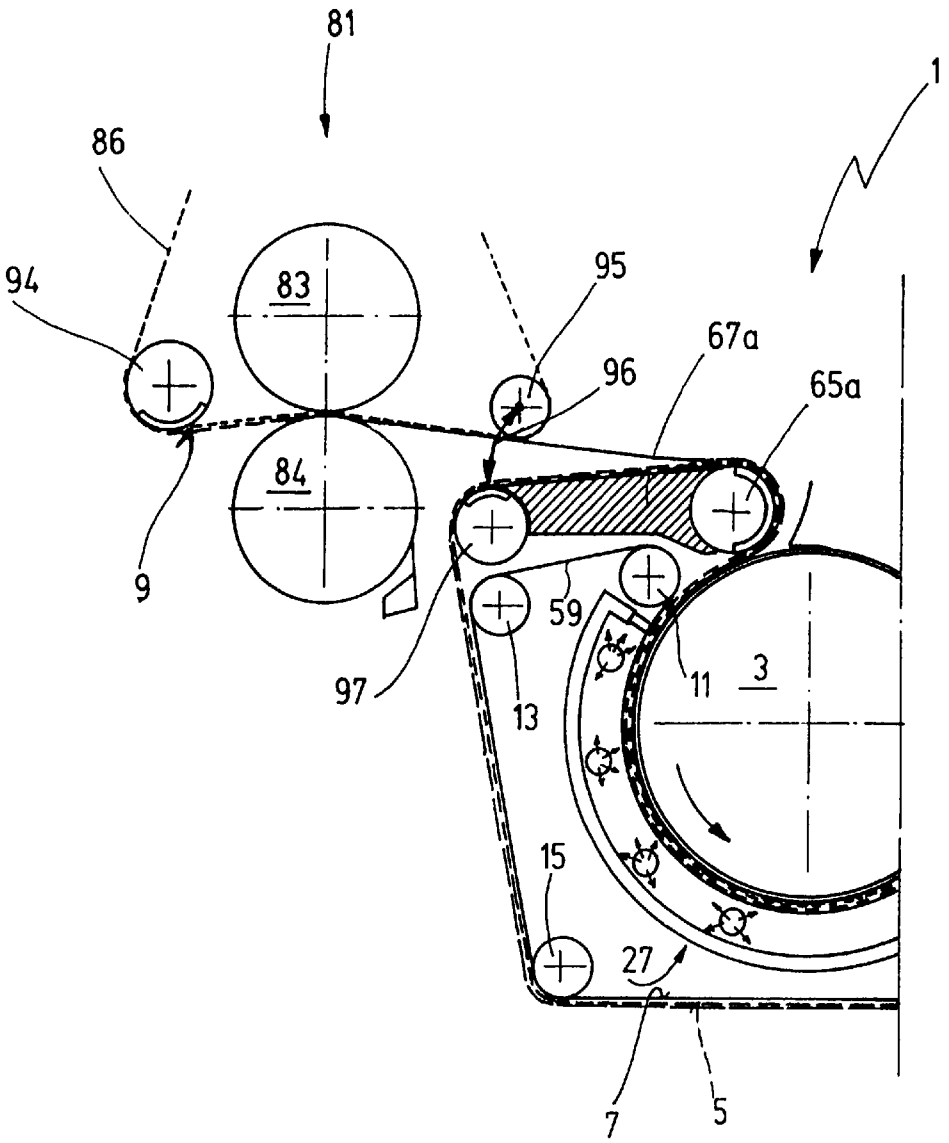

FIG. 11 depicts a variant embodiment of the coupling between a press 81 arranged upstream from the dryer section 1, viewed in the direction of travel of the material web, which differs from that in FIG. 9 substantially only in that only one pressing felt 86 is guided through the closed nip between the rollers 83, 84. The pressing felt 86 is first guided over a suction roller 94, on which the material web 9 is sucked onto the pressing felt 86. A deflecting roller 95 arranged downstream from the press 81, over which the pressing felt 86 is guided, is movable, purely by way of example, in the direction of an arrow 96 and can be pressed against the circumference of a suction roller 97, over which the support bands 5 and 7 are guided. In the embodiment depicted in FIG. 11, the nip between the movable deflecting roller 95 and the suction roller 97 can be closed such that a closed web path with a reliable transfer of the material web from the press 81 to the support bands 5, 7 of the dryer section can be realized. Also possible is a transfer with other known appropriately designed devices before the nip is closed. Obviously, it is also possible, for example, during continuous operation of the machine, that an open web path, as depicted in FIG. 11, is realized here, such that the bands and the pressing felt are protected.

Figure 12:
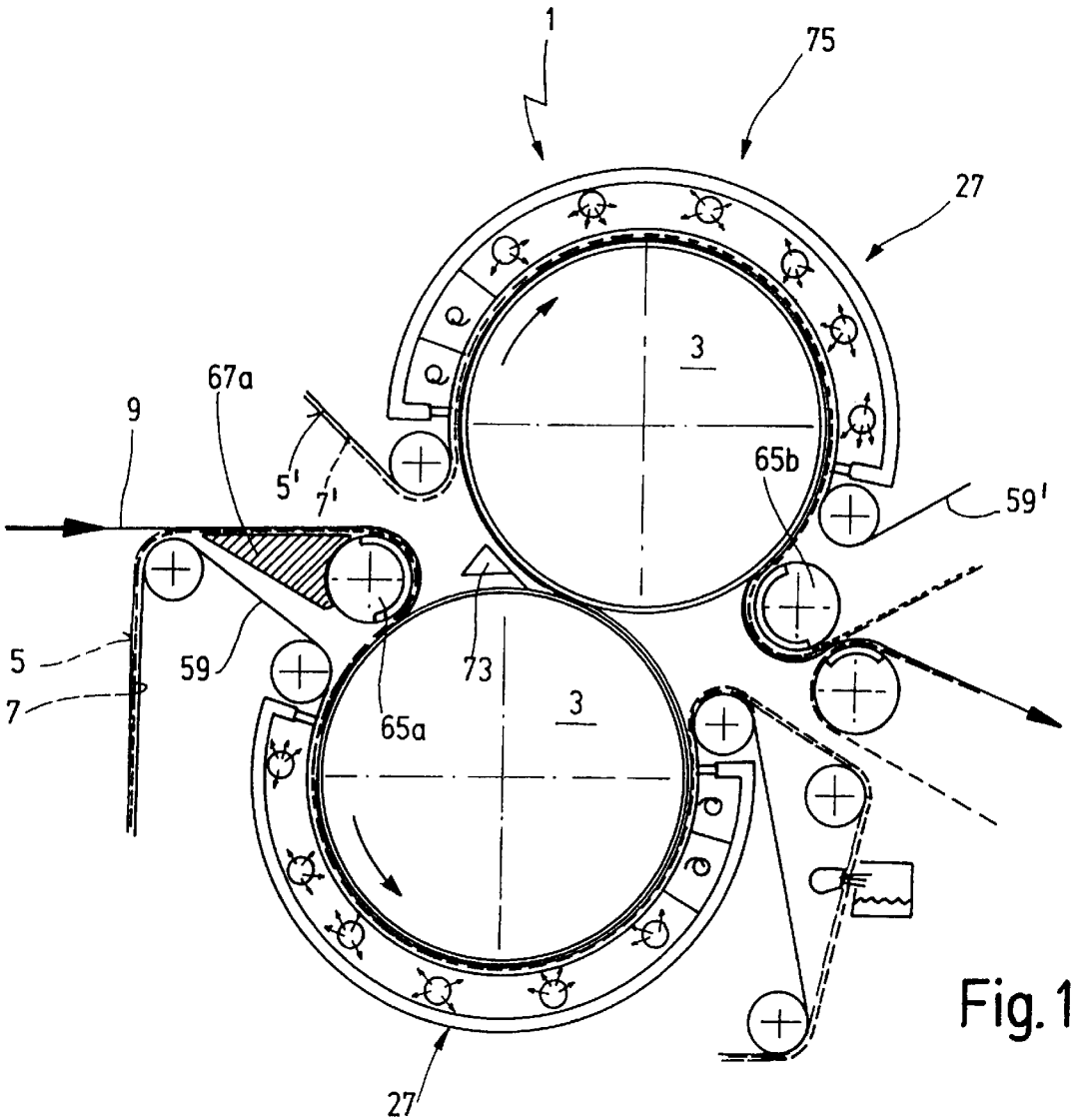

FIG. 12 depicts a detail from an especially economically producible exemplary embodiment of the dryer section 1, in which the material web 9 is transferred directly from the first drying cylinder of the dryer section 1 or the drying group 75 to the second drying cylinder 3. Consequently, guide devices, for example, guide rollers, suction boxes, or the like, are not necessary in the zone between two drying cylinders. A small distance, i.e., a short free path may, as depicted in FIG. 12, exist between the two drying cylinders 3, or the drying cylinders may make contact with each other on their circumference with a preferably slight pressure. The arrangement of the remaining elements and devices of a dryer section is preferably unchanged. For the transfer of the material web 9 from the first drying cylinder 3 to the next, a doctor 73, and possibly also a blowing device (not shown in FIG. 12), is used.

It is common to all exemplary embodiments described with reference to the figures that these may also be operated such that a fine porous wire, which preferably has high heat conductivity, is guided in direct contact with the material web on both sides. Because of these additional wires, the web path may be simplified. Suction rollers and suction boxes may be eliminated where they are not needed to guide the material web to a subsequent device.

With this variant embodiment, the web path must be appropriately modified in the transfer from the press upstream from the dryer section and in the transfer into the portion of the machine downstream from the dryer section, for example, to a conventional single-row or two-row drying group such that, in these locations, the additional wires can be applied to the material web or separated therefrom and can be guided back from the discharge point to the intake point of a cylinder.

In all the exemplary embodiments depicted in FIGS. 1 through 12, appropriate web guide elements, for example, wire or band travel controllers, tension devices, conditioning devices, transfer devices or additional blow pipes and doctors, which are known and consequently not depicted, are assumed.

In summary, it must be noted that in all exemplary embodiments of the dryer section 1 and the drying group 75 described with reference to the preceding figures, an overpressure cap described with reference to FIGS. 1 through 7 can be associated with the drying cylinders. The design of the overpressure cap is preferably adapted to the guidance of the material web, if provided of the support bands 5, 7 and/or the sealing band 59. Its own set of bands (support bands, sealing band, and the like) can be associated with each of the drying cylinders, or the bands are guided over a plurality of drying cylinders, such as, for example, in the exemplary embodiments depicted in FIGS. 9 and 10.

What is claimed is:

1. A dryer section of a machine for at least one of producing and processing a web of material, comprising:

at least one heatable drying cylinder having a circumference, at least a part said circumference adapted to be surrounded by the material web;

at least one support band arranged to surround said at least a part of said circumference;

a sealing band arranged to surround said at least a part of said circumference;

an overpressure cap arranged to receive one of a liquid and gaseous medium and adapted to apply a pressurized one of said liquid and gaseous medium on said at least one drying cylinder, wherein a temperature of said medium is lower than a temperature on an outside of said part of said circumference;

at least one second support band being arranged around said at least one drying cylinder and being positioned between said at least one support band and said sealing band, wherein said at least one second support band has a coarser structure than said at least one support band.

2. The dryer section in accordance with claim 1, further comprising a wire adapted to be positioned between the material web and said at least one drying cylinder.

3. The dryer section in accordance with claim 1, wherein said at least one drying cylinder comprises a plurality of drying cylinders, and said overpressure cap is associated with said plurality of drying cylinders, and wherein at least one of said at least one support band, said sealing band, and said at least one second support band is guided over said plurality of drying cylinders.

4. The dryer section in accordance with claim 3, wherein all of said at least one support band, said sealing band, and said at least one second support band are guided over said plurality of drying cylinders.

5. The dryer section in accordance with claim 1, wherein said at least one second support band is guided on an outside of said at least one support band around said at least one drying cylinder.

6. The drying section in accordance with claim 1, wherein said sealing band comprises a medium-impermeable sealing band arranged on an outside of said at least one second support belt around said at least one drying cylinder.

7. The drying section in accordance with claim 1, wherein at least two of said at least one support band, said at least one second support band, and said sealing band are connected to one another.

8. The drying section in accordance with claim 1, wherein the at least one drying cylinder is adapted to directly contact the material web.

9. The drying section in accordance with claim 1, further comprising a band being postioned between the material web and said at least one drying cylinder.

10. The drying section in accordance with claim 1, wherein said at least one drying cylinder comprises a plurality of drying cylinders and said overpressure cap is adapted to apply a pressurized one of said liquid and gaseous medium to said plurality of drying cylinders, wherein at least one of said at least one support band, said sealing band, and said at least one second support band is guided over said plurality of drying cylinders.

11. The drying section in accordance with claim 10, wherein all of said at least one support band, said sealing band, and said at least one second support band are guided over said plurality of drying cylinders.

12. The dryer section in accordance with claim 1, wherein said at least one drying cylinder comprises a plurality of drying cylinders, and wherein said overpressure cap is associated with at least some of said plurality of drying cylinders, and wherein at least one of said at least one support band, said sealing band, and said at least one second support band is guided over said plurality of drying cylinders.

13. The dryer section in accordance with claim 12, further comprising at least a second overpressure cap associated with a remaining portion of said plurality of drying cylinders which are not associated with said overpressure cap.

14. The dryer section in accordance with claim 1, wherein at least one of said at least one support band, said at least one second support band, and said sealing band is guided inside said overpressure cap.

15. The dryer section in accordance with claim 1, wherein at least one of said at least one support band, said at least one second support band, and said sealing band is guided outside of said the overpressure cap between a discharge zone, in which said at least one band is guided outside of said overpressure cap runs off said at least one drying cylinder, and an intake zone, in which said at least one band is guided outside of said overpressure cap runs onto said at least one drying cylinder.

16. The dryer section in accordance with claim 1, further comprising seals adapted to form pressure seals between a pressure chamber within said overpressure cap and its surroundings.

17. The dryer section in accordance with claim 16, further comprising guide rollers adapted for guiding at least one of said at least one band and the material web, wherein said seals are arranged to form a pressure seal with said guide rollers in one of a contacting and non-contacting manner.

18. The dryer section in accordance with claim 17, wherein said at least one drying cylinder includes ends and joumal pins, and said dryer section further comprises covers adapted to seal ends of said overpressure cap in one of a contacting and non-contacting manner against at least one of said circumference, said ends and journal pins and against said guide rollers.

19. The dryer section in accordance with claim 17, wherein at least one of said guide rollers is arranged to be pressable against said at least one drying cylinder.

20. The dryer section in accordance with claim 1, further comprising at least one guide roller positioned at arranged at a small distance from said at least one drying cylinder.

21. The dryer section in accordance with claim 20, further comprising at least one seal positioned adjacent a surface of said at least one guide roller to form pressure seal.

22. The dryer section in accordance with claim 1, further comprising two rollers arranged to form a press nip, wherein the material web is guided into a pressure chamber formed within said overpressure cap through said press nip.

23. The dryer section in accordance with claim 22, wherein said two rollers forming said press nip comprise a shoe press.

24. The dryer section in accordance with claim 1, wherein a band tension for at least one of said at least one support band, said at least one second support band, and said sealing band is adjustable.

25. The dryer section in accordance with claim 1, wherein said one of said liquid and gaseous medium is pressurized in said overpressure cap in a range between 0.001 bar absolute and 12 bar absolute.

26. The dryer section in accordance with claim 1, further comprising a pressing device arranged to support a pressing of the material web against said at least one drying cylinder, wherein said pressing device is adapted to apply pressing forces of different magnitudes over subzones of at least one of said circumference and a width of said at least one drying cylinder.

27. The dryer section in accordance with claim 1, wherein said overpressure cap comprises a pressing device having zones for applying different pressure values.

28. The dryer section in accordance with claim 27, wherein in said zones different pressing forces are applied in at least one of a travel direction and cross-wise to said travel direction of the material web.

29. The dryer section in accordance with claim 27, wherein said one of said liquid and gaseous medium comprises at least one of compressed air, drying air, vapor, and water.

30. The dryer section in accordance with claim 27, wherein said pressure values with the individual zones is variable.

31. The dryer section in accordance with claim 27, wherein same pressure relationships are present in all overpressure caps.

32. The dryer section in accordance with claim 27, wherein zones with different pressure levels with said overpressure cap are actuatable independently of one another.

33. The dryer section in accordance with claim 1, wherein said overpressure cap comprises at least two overpressure chambers arranged cross-wise to a travel direction of the material web, which are sealed against at least one of each other and the surroundings.

34. The dryer section in accordance with claim 33, wherein said overpressure cap comprises three overpressure chambers arranged cross-wise to a travel direction of the material web, which are sealed against at least one of each other and the surroundings.

35. The dryer section in accordance with claim 33, wherein said overpressure cap comprises four overpressure chambers arranged cross-wise to a travel direction of the material web, which are sealed against at least one of each other and the surroundings.

36. The dryer section in accordance with claim 33, further comprising sealing strips positioned between at least one of said at least two overpressure chambers and the surroundings, wherein said sealing strips are adapted to provide an adjustable outflow of air in order to establish a smooth pressure transition.

37. The dryer section in accordance with claim 1, wherein said sealing band is made of any substances/materials which have good heat conductivity.

38. The dryer section in accordance with claim 1, wherein said sealing band is made of at least one metal.

39. The dryer section in accordance with claim 38, wherein said at least one metal comprises steel.

40. The dryer section in accordance with claim 1, wherein said overpressure cap is arranged to seal at least said part of said circumference and is adapted to form one of a pressure chamber and an overpressure chamber in which said part of said circumference is located.

41. The dryer section in accordance with claim 1, wherein said web of material comprises one of paper and cardboard.

42. A dryer section of a machine for at least one of producing and processing a web of material, comprising:

at least one heatable drying cylinder having a circumference, at least a part said circumference adapted to be surrounded by the material web;

at least one support band arranged to surround said at least a part of said circumference;

an overpressure cap arranged to receive one of a liquid and gaseous medium and adapted to apply a pressurized one of said liquid and gaseous medium on said at least one drying cylinder, wherein a temperature of said medium is lower than a temperature on an outside of said part of said circumference;

at least one second support band being arranged around said at least one drying cylinder and being positioned adjacent said at least one support band, wherein said at least one second support band has a coarser structure than said at least one support band.

43. The dryer section in accordance with claim 42, wherein said at least one drying cylinder comprises a plurality of drying cylinders, and said overpressure cap is associated with said plurality of drying cylinders, and wherein at least one of said at least one support band and said at least one second support band is guided over said plurality of drying cylinders.

44. The dryer section in accordance with claim 42, wherein both of said at least one support band and said at least one second support band are guided over said plurality of drying cylinders.

45. The dryer section in accordance with claim 42, wherein said at least one second support band is guided on an outside of said at least one support band around said at least one drying cylinder.

46. The drying section in accordance with claim 42, further comprising a medium-impermeable sealing band arranged on an outside of said at least one second support belt around said at least one drying cylinder.

* * * * *